US007262691B2

(12) United States Patent
Kanayama

(10) Patent No.: US 7,262,691 B2
(45) Date of Patent: Aug. 28, 2007

(54) MECHANICAL SECURITY SYSTEM, CONTROL DEVICE, REMOTE ANNUNCIATOR, CONTROL METHOD AND CONTROL PROGRAM, COMPUTER-READABLE RECORDING MEDIUM RECORDING CONTROL PROGRAM

(75) Inventor: Kenji Kanayama, Kyoto (JP)

(73) Assignee: Omron Corporation, Kyoto-Shi (JP)

( * ) Notice: Subject to any disclaimer, the term of this patent is extended or adjusted under 35 U.S.C. 154(b) by 47 days.

(21) Appl. No.: 10/528,182

(22) PCT Filed: Jun. 2, 2004

(86) PCT No.: PCT/JP2004/007620

§ 371 (c)(1),
(2), (4) Date: Mar. 17, 2005

(87) PCT Pub. No.: WO2004/109618

PCT Pub. Date: Dec. 16, 2004

(65) Prior Publication Data

US 2005/0225442 A1 Oct. 13, 2005

(30) Foreign Application Priority Data

Jun. 4, 2003 (JP) ..... 2003-159693

(51) Int. Cl.
*G08B 29/00* (2006.01)

(52) U.S. Cl. ..... 340/506; 340/541

(58) Field of Classification Search ..... 340/506, 340/528, 539.14, 541, 5.2, 457, 539.13
See application file for complete search history.

(56) References Cited

U.S. PATENT DOCUMENTS

| | | | | |
|---|---|---|---|---|
| 4,090,182 | A * | 5/1978 | Young | 340/522 |
| 5,153,560 | A * | 10/1992 | Ichikawa | 340/522 |
| 5,801,625 | A | 9/1998 | Wang | 340/506 |
| 6,331,816 | B1 * | 12/2001 | Myllymaki | 340/540 |
| 6,549,142 | B2 * | 4/2003 | Thomas et al. | 340/691.1 |
| 6,774,782 | B2 * | 8/2004 | Runyon et al. | 340/505 |
| 2003/0164014 | A1 | 9/2003 | Matsushita et al. | |

FOREIGN PATENT DOCUMENTS

| | | |
|---|---|---|
| JP | 08-016963 | 1/1996 |
| JP | 10-69590 A | 3/1998 |
| JP | 11-086164 A | 3/1999 |
| JP | 2000-076572 A | 3/2000 |
| JP | 2000-83108 A | 3/2000 |
| JP | 2001-288939 | 10/2001 |
| JP | 2001-333216 | 11/2001 |
| JP | 2002-302014 A | 10/2002 |
| JP | 2003-87179 A | 3/2003 |
| JP | 2004-206531 A | 7/2004 |
| WO | WO - 98/16412 | 4/1998 |

* cited by examiner

*Primary Examiner*—Phung T. Nguyen
(74) *Attorney, Agent, or Firm*—Foley & Lardner LLP

(57) ABSTRACT

A security system includes: an outing motion detection sensor for detecting actions of a non-monitored person when leaving the monitored area; and human body sensors for detecting the non-monitored person in the monitored area, and a home controller includes: a mode switching section for switching between an alert mode and a non-alert mode; a storage section for storing sensor state accumulative data that indicates initial states of the human body sensors in the alert mode; a human body sensor confirming section for detecting a matching between detection states of the human body sensors and the sensor state accumulative data; and a mode switching reminder section for causing a remote alarm device located at a remote place to present mode change reminder information, when the outing motion detection sensor detects that the non-monitored person has left the monitored area, the detection states of the human body sensors are matched with the sensor state accumulative data, and the non-alert mode has been set. With this arrangement, it is possible to prevent the occurrence of absence of security measures caused by a human error.

17 Claims, 11 Drawing Sheets

FIG. 5

| | | STATES OF OUTING MOTION DETECTION SENSORS | | |
|---|---|---|---|---|
| | | HUMAN BODY SENSOR AT ENTRANCE (SA1) | OPEN-CLOSE DETECTION SENSOR ON FRONT DOOR (SA2) | HUMAN BODY SENSOR OUTSIDE FRONT DOOR (SA3) |
| TIME | tb | OFF | OFF | OFF |
| | t1 | ON | OFF | OFF |
| | t2 | ON | ON | OFF |
| | t3 | OFF | ON | ON |
| | t4 | OFF | OFF | ON |
| | ta | OFF | OFF | OFF |

FIG. 9

| | STATES OF HUMAN BODY SENSORS IN ROOMS | | | | | ACCUMULATIVE FREQUENCIES |
|---|---|---|---|---|---|---|
| | SIX-MAT WESTERN-STYLE ROOM (SB1) | KITCHEN (SB2) | SIX-MAT JAPANESE-STYLE ROOM (SB3) | VERANDA (SB4) | ENTRANCE (SA1) | |
| PATTERN 0 | OFF | OFF | OFF | OFF | OFF | 100 |
| PATTERN 1 | ON | OFF | OFF | OFF | OFF | 30 |
| PATTERN 2 | OFF | OFF | OFF | ON | OFF | 10 |
| PATTERN 3 | ON | OFF | OFF | ON | OFF | 2 |
| · | | | | | | |
| · | | | | | | |

MECHANICAL SECURITY SYSTEM, CONTROL DEVICE, REMOTE ANNUNCIATOR, CONTROL METHOD AND CONTROL PROGRAM, COMPUTER-READABLE RECORDING MEDIUM RECORDING CONTROL PROGRAM

Japan Priority Application 2003-159693, filed Jun. 04, 2003 including the specification, drawings, claims and abstract, is incorporated herein by reference in its entirety. This application is a National Stage of U.S. Application PCT/JP2004/007620, filed Jun. 02, 2004, incorporated herein by reference in its entirety.

TECHNICAL FIELD

The present invention relates to a security system, and particularly relates to a security system which prevents the occurrence of absence of security measures caused by a human error, a control device, a remote alarm device, a control method, and a control program, which are for the aforesaid security system, and a computer-readable storage medium storing the control program.

BACKGROUND ART

Along with rising crime, security systems in which security measures are automated by providing security sensors and the like in houses and buildings have become widely used. Wide variety of security systems have already been in practical use, e.g. ranging from a large-scale system in which a security center receives a security alert from a sensor via a computer network upon the detection of an intruder and the like by the sensor, so that a security guard is sent to the scene, to a simple system in which information detected by a sensor is sent to a mobile terminal such as a mobile phone of the user. Also, sensors that detect the existence of a human body, the breakdown of glass, fire, and gas leakage have been in practical use, thanks to sensing media that detect light, sound (including supersonic wave and acoustic pressure), electric waves (especially microwave), images, and others.

Prior art documents related to the present invention are the following Patent Documents 1-3.

Patent Document 1 (Japanese Laid-Open Patent Application No. 8-16963/1996; published on Jan. 19, 1996) discloses an alarm device which prevents the user from making an operation mistake and prevents a security alert from being mistakenly dispatched. More specifically, this alarm device is arranged such that a plurality of intrusion sensors are provided in a monitored area and an alert is automatically sent to a remote security center if an intrusion to the monitored area or an act of vandalism in the monitored area is detected by one of the intrusion sensors, and the alarm device includes: a controller provided in the monitored area; a mode setting device provided outside the monitored area; timer means that starts clocking in response to the operation of the controller, and stops the clocking after a predetermined period of time elapses; and control means. The control means sets the controller to an alert mode if the mode setting device is operated during the clocking of the timer means. If the mode setting device is operated after the clocking finishes, the control device does not set any security modes.

According to a portable remote moving picture transmission system of Patent Document 2 (Japanese Laid-Open Patent Application No. 2001-333216; published on Nov. 30, 2001), a photograph of an intruder is automatically sent to a next-generation mobile phone, rather than an alert is sent to a security company, so that the user can swiftly identify the intruder and contact the police, and as a result the payment to the security company can be reduced. More specifically, according to this portable remote moving picture transmission system, when an alert state is set by a key switch, the illegal intruder is sensed by a miniaturized human sensing light and a connected automatic reporting device is started. The automatic reporting device continuously starts connecting plural reporting destinations predetermined to the next generation portable telephone. By setting the next generation portable telephone of a party to automatic incoming call, when there is a report, an image automatically appears. Thus, the person concerned, who receives the image, can instantaneously judge conditions from the image and can report the movement of the illegal intruder or features of the face to the police as they are. When an erroneous report can be judged from the image such as when a member of company enters the room while forgetting the cancel of the key switch, for example, such a state can be judged by the image so that the report to the police is not required.

Patent Document 3 (Japanese Laid-Open Patent Application No. 2001-288939; published on Oct. 19, 2001) discloses a locking confirmation supporting apparatus which alleviates a fear of the user regarding locking, and is easy to use, inexpensive, and highly versatile. More specifically, the locking confirmation supporting apparatus is comprised of a key holder section for holding a key, and an electronic clock section consisting of a timer circuit, a CPU, a ROM, a RAM, and a display. Then, a locking confirmation signal is generated, and a current time point of locking is stored as a confirmation time point into the RAM of the electronic clock section, based on the locking confirmation signal, and a notice is sent to a liquid crystal display. The locking confirmation signal is generated by a key taking/ejecting means inclusive of a key taking/ejection-detecting switch provided in the key holder section, locking sound detecting means inclusive of a locking sound sensor such as a microphone, a manual input switch, etc. After locking, by operating a reconfirmation switch, the confirmation time point stored in the RAM is displayed again on the liquid crystal display.

However, in spite of remarkable development of devices and systems, human errors made by the users of buildings and houses invalidate such devices and systems and bring about absence of security measures, thereby causing a lot of troubles.

A representative example of the human errors is such that the user forgets to set an "alert mode". That is, security systems are typically arranged in such a manner that the user sets the security mode when he/she leaves home and wishes to let the house be watched, and releases the security mode upon the return to the house. In this case, the security system does not turn on if the user forgets to set the security mode or does not set the mode for some reason, so that the security measures do not operate.

There have been no proposals to provide measurements for spotting such human errors, because it has been difficult to accurately spot the errors with low costs.

As described above, conventional security systems cannot, for instance, gives advise, alarm, or the like to set the security mode to the user, in order to prevent a human error by the user of buildings, houses, and the like. In other words, the conventional systems cannot cover for human errors without imposing a burden on the user.

DISCLOSURE OF INVENTION

An object of the present invention is to provide a security system which prevents the occurrence of absence of security measures caused by a human error and can significantly improve the level of security, a control device, a remote alarm device, and a control method which are for the aforesaid security system. Also, an object of the present invention includes to provide a control program which realizes the aforesaid security system, and a computer-readable storage medium storing the control program.

In order to achieve the above object, a security system of the present invention is arranged so as to include: a control device for performing a predetermined coping action when an abnormality is detected in a monitored area; an outing motion detection sensor for detecting actions of a non-monitored person when leaving the monitored area; and a non-monitored person detecting sensor for detecting the non-monitored person in the monitored area, the control device including: a mode switching section (mode switching means) for switching between an alert mode with which the coping action is performed if the abnormality is detected in the monitored area and a non-alert mode with which the coping action is not performed; and a mode switching reminder section (mode switching reminder means) for causing a remote alarm device located at a remote place to present mode change reminder information, when the outing motion detection sensor detects that the non-monitored person has left the monitored area, the non-monitored person detecting sensor does not detect any other non-monitored person, and the non-alert mode has been set.

With this arrangement, when the outing motion detection sensor detects that a non-monitored person has left the area, the non-monitored person detecting sensor does not detect the presence of any other user, and the non-alert mode has been set, it is possible to advise the user of the security service to switch to the alert mode by causing the remote alarm device to present the mode change reminder information. With this, the occurrence of the absence of security measures caused by a human error can be prevented, and this brings about the effect that the level of security can be significantly improved.

Further, a security system of the present invention is arranged so as to include: a control device for performing a predetermined coping action when an abnormality is detected in a monitored area; an outing motion detection sensor for detecting actions of a non-monitored person when leaving the monitored area; and a plurality of non-monitored person detecting sensors for detecting the non-monitored person in the monitored area, the control device including: a mode switching section (mode switching means) for switching between an alert mode with which the coping action is performed if the abnormality is detected in the monitored area and a non-alert mode with which the coping action is not performed; a storage section for storing initial state data that indicates initial states of the non-monitored person detecting sensors in the alert mode; an initial state detection section (human body sensor confirming section, initial state detection means) for detecting a matching between detection states of the non-monitored person detecting sensors and the initial state data; and a mode switching reminder section (mode switching reminder means) for causing a remote alarm device located at a remote place to present mode change reminder information, when the outing motion detection sensor detects that the non-monitored person has left the monitored area, the detection states of the non-monitored person detecting sensors are matched with the initial state data, and the non-alert mode has been set.

With this arrangement, when the outing motion detection sensor detects that the non-monitored person has left the area, the detection states of the non-monitored person detecting sensors are matched with the initial state data, and the non-alert mode has been set, it is possible to advise the user of the security service to switch to the alert mode by causing the remote alarm device to present the mode change reminder information. With this, the occurrence of the absence of security measures caused by a human error can be prevented, and this brings about the effect that the level of security can be significantly improved.

Still further, a security system of the present invention is arranged so as to include: a control device for performing a predetermined coping action when an abnormality is detected in a monitored area; and an outing motion detection sensor for detecting actions of a non-monitored person when leaving the monitored area, the control device including: a mode switching section (mode switching means) for switching between an alert mode with which the coping action is performed if the abnormality is detected in the monitored area and a non-alert mode with which the coping action is not performed; and a mode switching reminder section (mode switching reminder means) for causing a remote alarm device located at a remote place to present mode change reminder information, when the outing motion detection sensor detects that the non-monitored person has left the monitored area, and the non-alert mode has been set.

With this arrangement, when the outing motion detection sensor detects that the non-monitored person has left the area, and the non-alert mode has been set, it is possible to advise the user of the security service to switch to the alert mode by causing the remote alarm device to present the mode change reminder information. With this, the occurrence of the absence of security measures caused by a human error can be prevented, and this brings about the effect that the level of security can be significantly improved.

Yet further, a security system of the present invention is arranged such that the outing motion detection sensor is provided so as to detect actions of the non-monitored person who passes an exit (for example, front door) of the monitored area from the inside of the monitored area to the outside.

Therefore, further, this brings about the effect that it is possible to reliably detect that the non-monitored person has left the monitored area.

Further, a security system of the present invention is arranged so as to include: a control device for performing a predetermined coping action when an abnormality is detected in a monitored area; and a non-monitored person detecting sensor for detecting the non-monitored person in the monitored area, the control device including: a mode switching section (mode switching means) for switching between an alert mode with which the coping action is performed if the abnormality is detected in the monitored area and a non-alert mode with which the coping action is not performed; and a mode switching reminder section (mode switching reminder means) for causing a remote alarm device located at a remote place to present mode change reminder information, when the non-monitored person detecting sensor detects no non-monitored person, and the non-alert mode has been set.

With this arrangement, when the non-monitored person detecting sensor detects no non-monitored person, and the non-alert mode has been set, it is possible to advise the user of the security service to switch to the alert mode by causing the remote alarm device to present the mode change reminder information. With this, the occurrence of the absence of security measures caused by a human error can be prevented, and this brings about the effect of the level of security can be significantly improved.

Still further, a security system of the present invention is arranged so as to include: a control device for performing a predetermined coping action when an abnormality is detected in a monitored area; and a plurality of non-monitored person detecting sensors for detecting the non-monitored person in the monitored area, the control device including: a mode switching section (mode switching means) for switching between an alert mode with which the coping action is performed if the abnormality is detected in the monitored area and a non-alert mode with which the coping action is not performed; a storage section for storing initial state data that indicates initial states of the non-monitored person detecting sensors in the alert mode; and an initial state detection section (human body sensor confirming section, initial state detection means) for detecting a matching between detection states of the non-monitored person detecting sensors and the initial state data; and a mode switching reminder section (mode switching reminder means) for causing a remote alarm device located at a remote place to present mode change reminder information, when the detection states of the non-monitored person detecting sensors are matched with the initial state data, and the non-alert mode has been set.

With this arrangement, when the detection states of the non-monitored person detecting sensors are matched with the initial state data, and the non-alert mode has been set, it is possible to advise the user of the security service to switch to the alert mode by causing the remote alarm device to present the mode change reminder information. With this, the occurrence of the absence of security measures caused by a human error can be prevented, and this brings about the effect that the level of security can be significantly improved.

Yet further, a security system of the present invention is arranged such that the control device further includes a sensor state accumulating section (initial state data accumulative storing means) for, when switching to the alert mode is carried out in accordance with an instruction from a user, storing, in the storage section, the initial state data in which the detection states of the non-monitored person detecting sensors at the time of the switching to the alert mode or after a predetermined period has elapsed from the switching to the alert mode are associated with the accumulative frequencies of the detection states, and the initial state detection means (human body sensor confirming section, initial state detection means) compares a pattern of the detection states of the non-monitored person detecting sensors with highest accumulative frequency patterns, the number of which is predetermined, in the initial state data stored in the storage section, so as to detect a matching therebetween.

Therefore, the accumulative frequencies of the patterns of the detection states of the non-monitored person detecting sensors when the user surely sets the alert mode are obtained, and as a result of judgment from the obtained accumulative frequencies, it is possible to certainly recognize whether or not the alert mode has been set from the detection states of the non-monitored person detecting sensors.

With this, the initial states of the non-monitored person detecting sensors, not limited to the initial states in which the non-monitored person detecting sensors are all OFF, can be flexibly detected. This brings about the effect that it is possible to increase the reliability of the decision of whether or not the mode change reminder information should be sent in order to advice the user to switch to the alert mode.

Further, the security system of the present invention is arranged such that the remote alarm device includes a switching instruction input section (remote-switching instruction input means) for the user inputting a mode switching instruction to the alert mode, and the mode switching section (mode switching means) of the control device switches to the alert mode in accordance with the mode switching instruction received from the remote alarm device.

This further, brings about the effect that even if the user leaves home without switching to the alert mode, the user away from home can carry out switching to the alert mode in response to the presentation of mode change reminder information through the remote alarm device.

Still further, the security system of the present invention includes: a control device for performing a predetermined coping action when an abnormality is detected in a monitored area; an outing motion detection sensor for detecting actions of a non-monitored person when leaving the monitored area; and a non-monitored person detecting sensor for detecting the non-monitored person in the monitored area, the control device includes: a mode switching section (mode switching means) for switching between an alert mode with which the coping action is performed if the abnormality is detected in the monitored area and a non-alert mode with which the coping action is not performed, the mode switching means automatically switching to the alert mode when the outing motion detection sensor detects that the non-monitored person has left the monitored area, the non-monitored person detecting sensor does not detect any other non-monitored person, and the non-alert mode has been set.

With this arrangement, when the outing motion detection sensor detects that the non-monitored person has left the monitored area, the non-monitored person detecting sensor does not detect any other user, and the non-alert mode has been set, the security system can automatically switch to the alert mode without the instruction to switch to the alert mode from the user of the security service. With this, the occurrence of the absence of security measures caused by a human error can be prevented, and this brings about the effect that the level of security can be significantly improved.

Yet further, a security system of the present invention includes: a control device for performing a predetermined coping action when an abnormality is detected in a monitored area; and an outing motion detection sensor for detecting actions of a non-monitored person when leaving the monitored area; the control device including: a mode switching section (mode switching means) for switching between an alert mode with which the coping action is performed if the abnormality is detected in the monitored area and a non-alert mode with which the coping action is not performed, the mode switching means automatically switching to the alert mode when the outing motion detection sensor detects that the non-monitored person has left the monitored area, and the non-alert mode has been set.

With this arrangement, when the outing motion detection sensor detects that the non-monitored person has left the monitored area, and the non-alert mode has been set, the security system can automatically switch to the alert mode without the instruction to switch to the alert mode from the user of the security service. With this, the occurrence of the absence of security measures caused by a human error can be prevented, and this brings about the effect that the level of security can be significantly improved.

Further, a security system of the present invention includes: a control device for performing a predetermined coping action when an abnormality is detected in a monitored area; and a plurality of non-monitored person detecting sensors for detecting the non-monitored person in the monitored area, the control device including: a mode switching section (mode switching means) for switching between an alert mode with which the coping action is performed if the abnormality is detected in the monitored area and a non-alert mode with which the coping action is not performed; a storage section for storing initial state data that indicates initial states of the non-monitored person detecting sensors in the alert mode; and an initial state detection section (human body sensor confirming section, initial state detection means) for detecting a matching between detection states of the non-monitored person detecting sensors and the initial state data, the mode switching means automatically switching to the alert mode, when the detection states of the non-monitored person detecting sensors are matched with the initial state data, and the non-alert mode has been set.

With this arrangement, when the detection states of the non-monitored person detecting sensors are matched with the initial state data, and the non-alert mode has been set, the security system can automatically switch to the alert mode without the instruction to switch to the alert mode from the user of the security service. With this, the occurrence of the absence of security measures caused by a human error can be prevented, and this brings about the effect that the level of security can be significantly improved.

Still further, the security system of the present invention includes a mode switching reminder section (mode switching report means) for causing a remote alarm device located at a remote place to present mode change report information, when the mode switching section (mode switching means) automatically switches to the alert mode.

With this arrangement, even if the user leaves home without switching to the alert mode, it is possible for the user to receive, through the remote alarm device, the report that the security system automatically has switched to the alert mode. This brings about the effect that it is possible to bring peace of mind to the user.

Note that, the foregoing security system may be realized by a computer. In this case, the invention also includes (i) a control program that realizes on the computer the foregoing security system by causing the computer to function as each of the foregoing means, and (ii) a computer-readable storage medium storing the foregoing control program.

For a fuller understanding of the nature and advantages of the invention, reference should be made to the ensuing detailed description taken in conjunction with the accompanying drawings.

BRIEF DESCRIPTION OF DRAWINGS

FIG. 5 is an explanatory diagram illustrating concrete examples of detection states of an outing motion detection sensors provided in the security systems illustrated in FIGS. 1, 3, and 6.

FIG. 9 is an explanatory diagram illustrating a concrete example of sensor state accumulative data of the security systems illustrated in FIGS. 1 and 11.

BEST MODE FOR CARRYING OUT THE INVENTION

One embodiment of the present invention is described below with reference to FIGS. 1-11.

Figure 1:
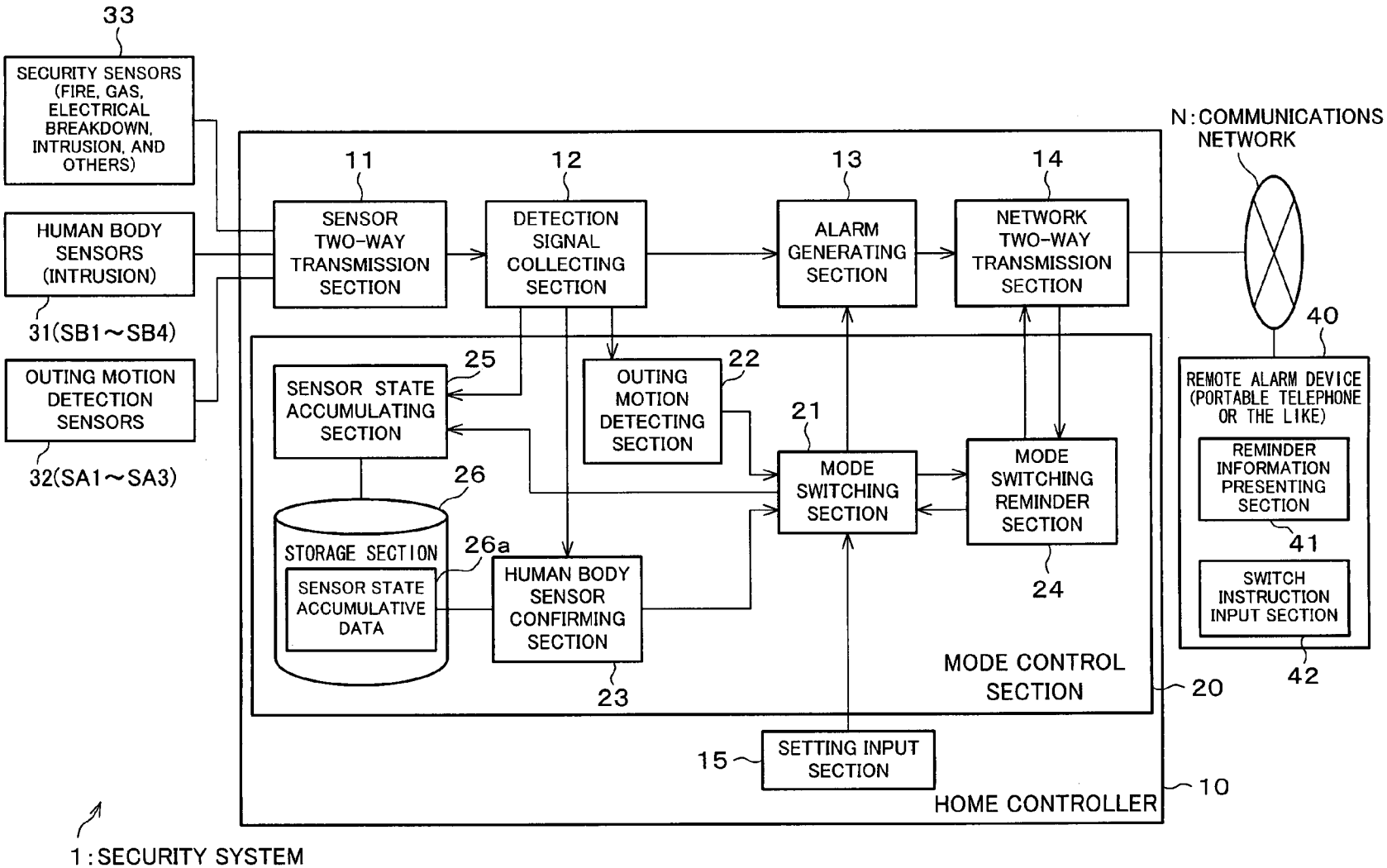
FIG. 1 is a functional block diagram illustrating a configuration of a security system of an embodiment of the present invention.
Figure 2:
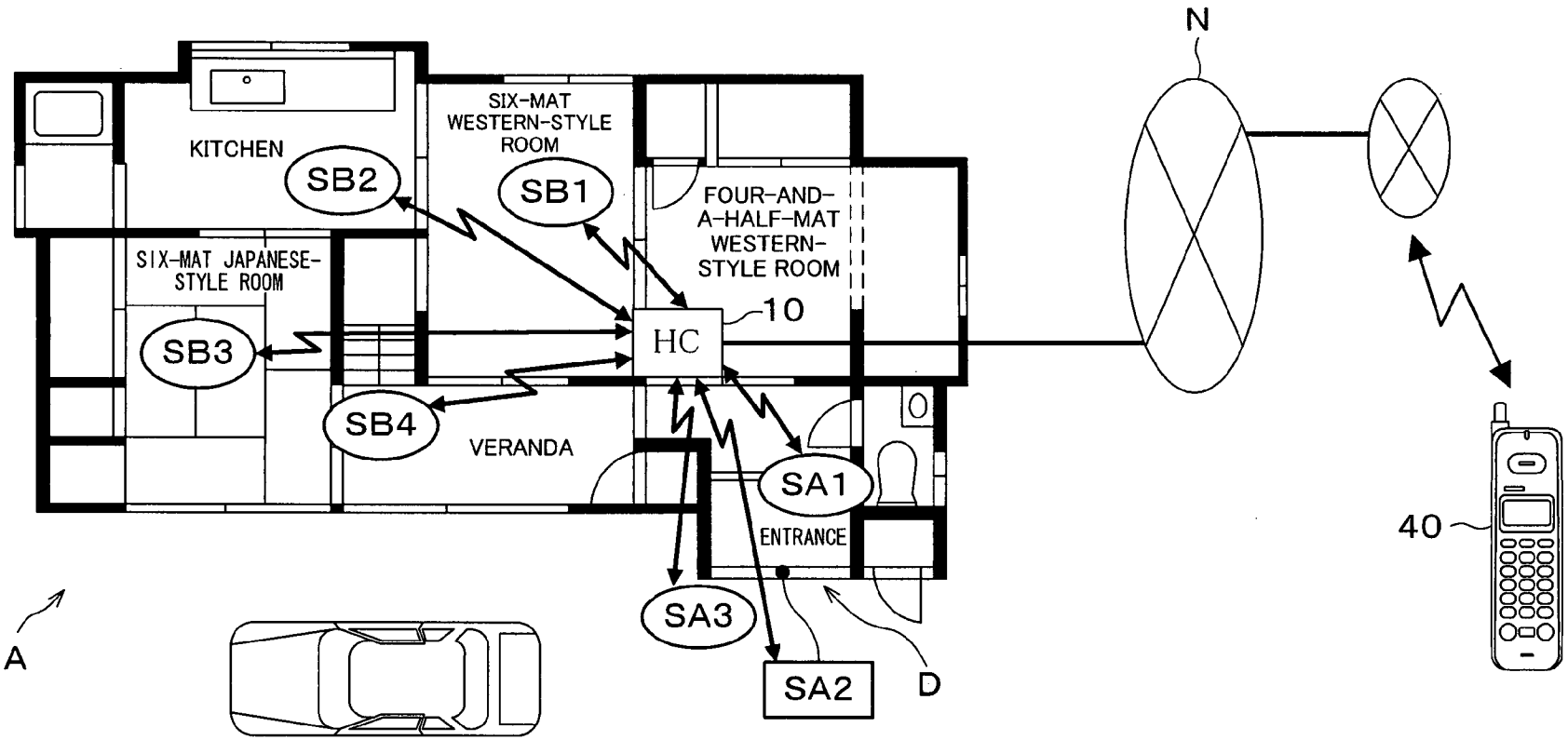
FIG. 2 is an explanatory diagram schematically illustrating a configuration of the security system of the embodiment of the present invention.

FIG. 1 is a functional block diagram illustrating in detail a configuration of a security system 1 of the present embodiment. FIG. 2 is an explanatory diagram schematically illustrating a configuration of this security system 1. FIGS. 3, 6, 7, and 11 are functional block diagrams illustrating in detail a configuration of an alternative example of the security system 1 illustrated in FIG. 1. Note that members having the same functions are given the same reference numbers, so that the descriptions thereof are omitted for the sake of convenience.

The present embodiment describes the security system 1, which is a typical home security system, in which detection information detected by security sensors 33 installed in a house is supplied to a mobile phone of the user. It is noted that the security system of the present invention may be widely applied to another system arranged in a different manner, e.g. a system which includes a security center.

When an abnormality regarding the house is detected in accordance with a detection signal from the security sensor 33, the security system 1 performs a predetermined coping action such as issuing an alert, under the control of the home controller 10. In the security system 1, it is possible through the home controller 10 to switch between (i) an alert mode with which the coping action is performed upon detection of an abnormality regarding the house and (ii) a non-alert mode with which the aforesaid action is not performed. Moreover, even if the user has left home without setting the alert mode, the security system 1 detects that the user has left home without setting the alert mode, so as to (1) automatically switch over to the alert mode or (2) provide mode change reminder information to a remote alarm device 40 such as a mobile phone, in order to advice the user to switch the security system to the alert mode. The user away from home can switch the mode of the security system to the alert mode, by means of the remote alarm device 40. In order to detect that the user forgot to set the alert mode, the security system 1 (1) detects the outing motion of the user and/or (2) compares detection states of human body sensors in the non-alert mode with initial states in the alert mode to determined if there is a matching.

As illustrated in FIG. 1, the security system 1 is arranged in such a manner that a sensor two-way transmission section 11 of the home controller 10 is connected with the human body sensors 31, outing motion detection sensors 32, and the security sensors 33, while a network two-way transmission section 14 is connected to the remote alarm device 40 via a communications network N.

As illustrated in FIG. 2, these sensors and the home controller 10 of the security system 1 are set up in the house that is a monitored area A, in the following manner: A four-and-a-half-mat Western-style room is provided with a home controller (HC). A six-mat Western-style room, a kitchen, a six-mat Japanese-style room, and a veranda are provided with human body sensors SB1-SB4, respectively. A human body sensor SA1 is provided at an entrance, an open-close detection sensor SA2 is provided on a front door D, and a human body sensor SA3 is further provided outside the front door D. These sensors send and receive signals to/from the home controller 10, through wired/wireless communications. It is noted that the human body sensors SB1-SB4 correspond to the human body sensors 31 illustrated in FIG. 1. Also, the human body sensors SA1 and SA3 and the open-close detection sensor SA2 at the front door D correspond to the outing motion detection sensors 32 in FIG. 1.

Although not illustrated in FIG. 2 as being identical with the conventional one, the security sensors 33 are also provided in suitable locations in the house. The signal transmissions between the security sensors 33 and the home controller 10 are also performed in a manner identical with those between the other sensors and the home controller 10. Furthermore, the performances, positions, and numbers of the human body sensors 31, the outing motion detection sensors 32, and the security sensors 33 can be arbitrarily determined in view of the purpose of the security.

The security sensors 33 detect an abnormality in the monitored area A. These sensors 33 can be provided in line with the purpose of the security. For instance, the security sensors 33 detect the presence of a human body, the break down of glass, fire, gas leakage, a temperature of an air conditioner, turn-off of a breaker, and the like, by means of sensing media such as light, sound (including supersonic wave and acoustic pressure), electric waves (especially microwave), and images.

In non-alert mode, the human body sensors 31 detect a non-monitored person in the monitored area A. This non-monitored person is a non-intruder whose presence is not seen as an abnormality, and is an inhabitant of the house (FIG. 2) in a practical sense. Hereinafter, the non-monitored person and the administrator who can switch between the modes are regarded as an identical person, and both of them are referred to as "user".

The outing motion detection sensors 32 are provided in such a manner that they can detect the motion of the user leaving the monitored area A. The outing motion detection sensors 32 are, for instance, provided so as to detect a sequence of actions of the user who passes the exit (front door D) of the monitored area A, from the inside of the monitored area A to the outside. More specifically, as illustrated in FIG. 2, the human body sensor SA1 is provided at the entrance, the open-close detection sensor SA2 is provided on the front door D, and the human body sensor SA3 is provided outside the front door D. Note that, as the open-close detection sensor SA2 on the front door D, a magnet switch can be adopted.

Examples of the human body sensors 31, the outing motion detection sensors 32, and the security sensors 33 which are sensors detecting a human body include a pyroelectric human body sensor that detects a body temperature of a person who enters the monitored area and then outputs a signal. Apart from this sensor, a human body can be detected using a Doppler sensor and a photoelectric sensor, or by processing images taken by a video camera.

The human body sensors 31 and the outing motion detection sensors 32 may function as the security sensors 33 that detect an intrusion in the alert mode. That is to say, the human body sensors 31 and the outing motion detection sensors 32 can be used as the security sensors 33. More specifically, the following arrangement can be realized: in the non-alert mode, the human body sensors SB1-SB4, the human body sensors SA1 and SA3, and the open-close detection sensor SA2 on the front door D, which are illustrated in FIG. 2, are caused to function as the human body sensors 31 and the outing motion detection sensors 32, while, in the alert mode, these sensors SB1-SB4, SA1, SA3, and SA2 are caused to function as the security sensors 33. Furthermore, apart from the human body sensors SB1-SB4, SA1, and SA3, the security sensors 33 may include another human body sensor. Incidentally, it is noted that FIGS. 1, 3, 6, 7, and 11 premise on the above-described case. As a matter of course, human body sensors exclusively for detecting the user may be different from human body sensors exclusively for detecting an intruder.

As illustrated in FIG. 1, the home controller 10 includes: the sensor two-way transmission section 11; a detection signal collecting section 12; an alarm generating section 13; the network two-way transmission section 14; a setting input section 15, and a mode control section 20. By the way, the home controller 10 is preferably provided with a chargeable secondary battery, in consideration of power failures.

The sensor two-way transmission section 11 performs communications with the sensors (human body sensors 31, the outing motion detection sensors 32, and the security sensors 33). More specifically, the sensor two-way transmission section 11 may perform wired or wireless communications.

The detection signal collecting section 12 collects and processes the detection signals supplied from the respective sensors. The detection signal collecting section 12 then supplies the detection signals, which are collected from the security sensors 33, to the alarm generating section 13. Also, the detection signal collecting section 12 supplies, to the human body sensor confirming section 23 and the sensor state accumulating section 25, the detection signals collected from the human body sensors 31. Moreover, the detection signal collecting section 12 supplies, to the outing motion detecting section 22, the detection signals collected from the outing motion detection sensors 32.

In the alert mode, the alarm generating section 13 performs the predetermined coping action when the security sensors 33 detect an abnormality. As the coping action, the security system 1 sends an alert to the remote alarm device 40. In addition to this, an alert may be suitably supplied to the police, fire station, security center, and the like. The alarm generating section 13 sets a mode in accordance with a control signal supplied from a mode switching section 21.

The network two-way transmission section 14 performs the communications with the communications network N. The communications network N is, for example, the Internet.

The setting input section 15 is a user interface for the user of the security system 1. This setting input section 15 allows the user to set the alert mode and the like and displays various kinds of information.

The mode control section 20 controls the mode of the alarm generating section 13. To do so, the mode control section 20 includes: the mode switching section 21, the outing motion detecting section 22, the human body sensor confirming section 23, a mode switching reminder section 24, the sensor state accumulating section 25, and a storage section 26. By the way, the sensor state accumulating section 25 and the storage section 26 will be described later.

The outing motion detecting section 22 detects the motion of the user going out from the monitored area A, in accordance with the detection states of the outing motion detection sensors 32. The outing motion detecting section 22 obtains the detection states via the sensor two-way transmission section 11 and the detection signal collecting section 12. As described above, the outing motion detection sensors 32 include the human body sensors SA1 and SA3 and the open-close detection sensor SA2 on the front door D.

The human body sensor confirming section 23 judges whether or not the detection states of the human body sensors 31 in the non-alert mode are in predetermined states. These detections states of the human body sensors 31 are obtained via the sensor two-way transmission section 11 and the detection signal collecting section 12. In the simplest case, the human body sensor confirming section 23 confirms that the detection states of the human body sensors 31 are all OFF (Pattern 0), i.e. conforms that no one is in the monitored area A. Also, the human body sensor confirming section 23 compares a pattern of the detection states of the human body sensors 31 with highest accumulative frequency patterns (e.g. Patterns 0-2), the number of which is predetermined, in sensor state accumulative data 26*a* (FIG. 9) stored in the storage section 26, so as to detect a matching therebetween. This matching will be described later in conjunction with the sensor state accumulating section 25 and the storage section 26.

In accordance with a mode switching instruction inputted by the user, the mode switching section 21 switches between (i) the alert mode with which the coping action is performed if the security sensors 33 detect an abnormality and (ii) the non-alert mode with which the coping action is not performed. This mode switching instruction is either inputted using the setting input section 15 or supplied from the remote alarm device 40.

The mode switching instruction is inputted using the setting input section 15, when the user in the monitored area A switches from the non-alert mode to the alert mode, before leaving home. Meanwhile, the mode switching instruction is supplied from the remote alarm device 40, basically when the user who has received the mode reminder information inputs the instruction from the outside of the monitored area A. As a matter of course, the user outside of the monitored area A can input the mode switching instruction using the remote alarm device 40, before receiving the mode reminder information.

When the mode switching section 21 in the non-alert mode detects that the user has left home, the mode switching section 21 causes the mode switching reminder section 24 to send the mode change reminder information to the remote alarm device 40. The mode switching section 21 performs this action when the non-alert mode is set and one of the following conditions is met: the outing motion detection sensors 32 detect that the user has left home (Situation 1 (FIG. 6)); the human body sensor 31 does not detect the user (Situation 2 (FIG. 7)); the detection states of the human body sensors 31 are matched with the initial state of the alert mode (Situation 3 (FIG. 11)); the outing motion detection sensors 32 detect that the user has left home and the human body sensors 31 do not detect any other users (Situation 4 (FIG. 3)); and the outing motion detection sensors 32 detect that the user has left home and the detection states of the human body sensors 31 are matched with the initial state of the alert mode (Situation 5 (FIG. 1)).

The mode switching reminder section 24 sends the mode change reminder information to the remote alarm device 40 carried by the user away from home, via the network two-way transmission section 14 and the communications network N. The mode change reminder information can be delivered to the user in any manner, as long as the user is informed that the security system 1 is in the non-alert mode and is advised to switch to the alert mode. More specifically, the mode change reminder information may be presented as images and texts, or may be delivered as one of alarm sound, illumination of a lamp, and vibration.

Upon receiving, from the remote alarm device 40, the instruction to switch to the alert mode in response to the mode change reminder information, the mode switching reminder section 24 supplies, to the mode switching section 21, a control signal indicating the mode change.

The remote alarm device 40 is a portable communication device that the user can carry around. This remote alarm device 40 is provided with a reminder information providing section 41 and a switch instruction input section 42. To form the reminder information presenting section 41 and the switch instruction input section 42, the remote alarm device 40 has user interfaces such as a display panel, a speaker, a vibration motor, a keyboard, a dial and the like, which are suitable for presenting and inputting information.

The reminder information presenting section 41 presents the mode change reminder information supplied from the home controller 10. The switch instruction input section 42 is used by the user to input the instruction to switch to the alert mode.

The remote alarm device 40 is preferably arranged in such a manner that the user never leaves home without the remote alarm device 40. For instance, the functions of the remote alarm device 40 may be incorporated into a mobile terminal such as a mobile phone, PHS, and PDA. Alternatively, the remote alarm device 40 may be integrated with a key for the exit of the monitored area A or a remote-key to a car.

Figure 3:
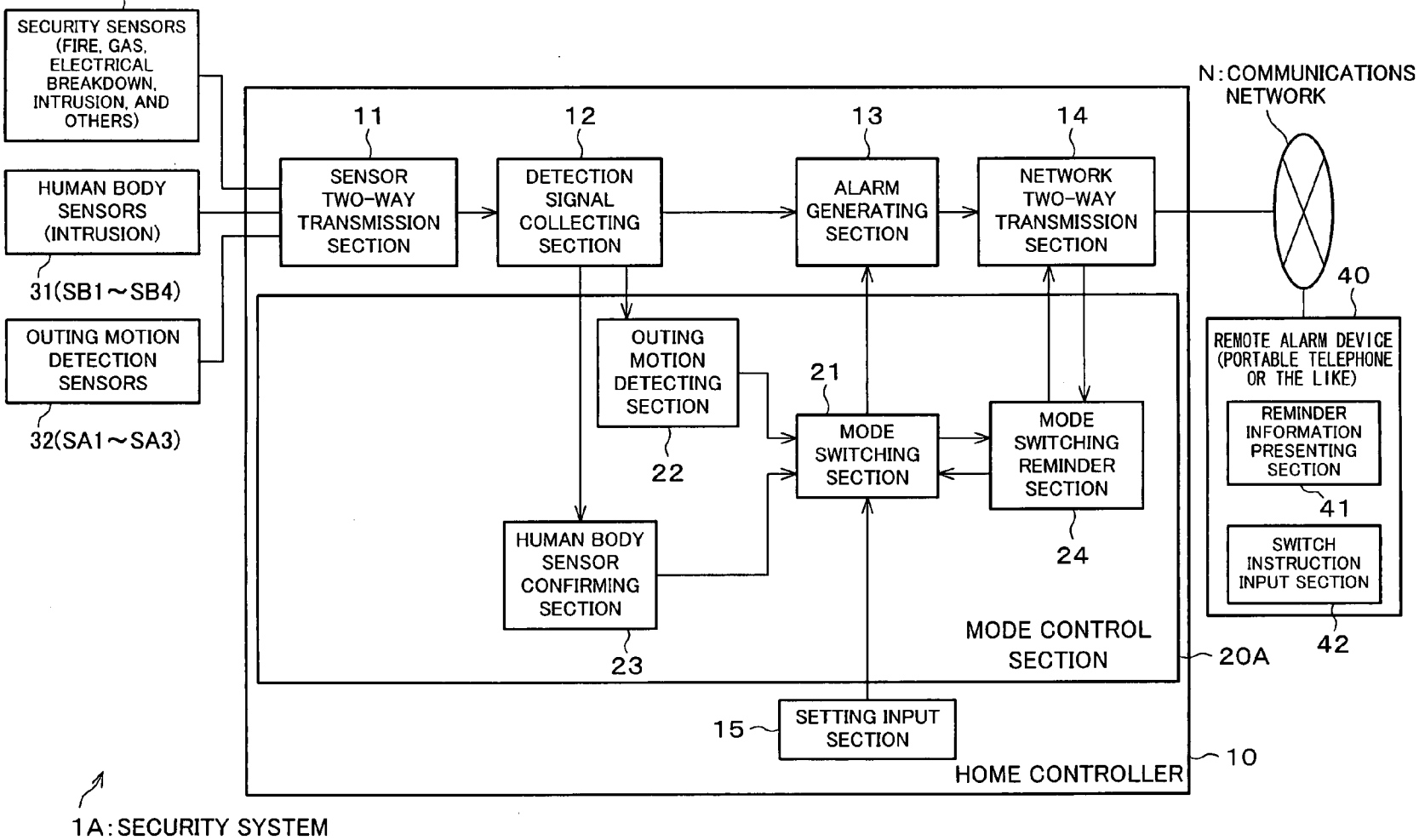
FIG. 3 is a functional block diagram illustrating an alternative example of the security system illustrated in FIG. 1.

A security system 1A illustrated in FIG. 3 is now discussed. This security system 1A is provided with a mode control section 20A that is identical with the mode control section 20 (FIG. 1), except that the sensor state accumulating section 25 and the storage section 26 are not provided.

Figure 4:
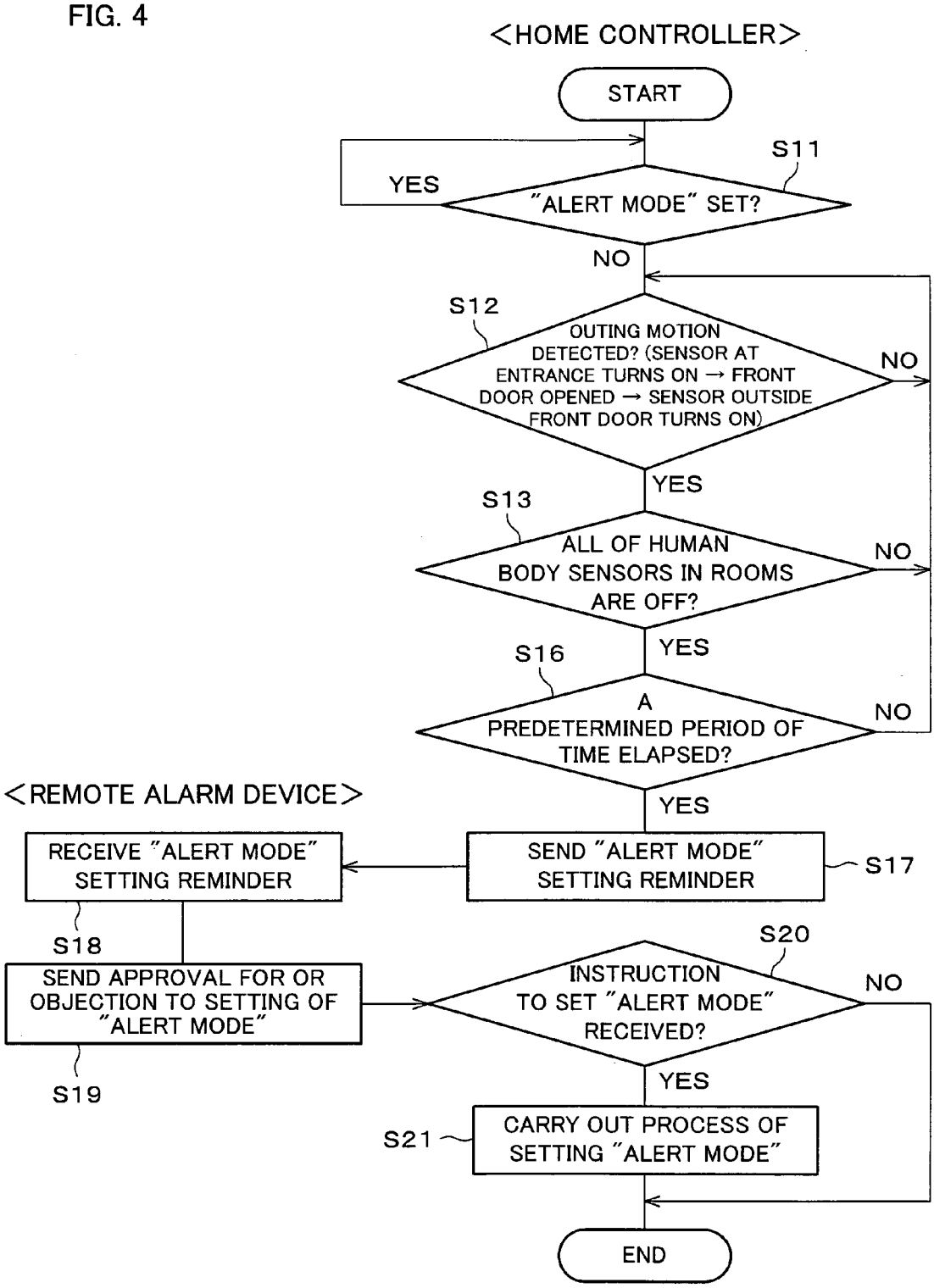
FIG. 4 is a flowchart illustrating how the security system illustrated in FIG. 3 operates.

FIG. 4 is a flowchart illustrating how the security system 1A illustrated in FIG. 3 operates.

When the user has left home without setting the alert mode, i.e. in the non-alert state (NO in S11), the outing motion detecting section 22 checks the detection state of the outing motion detection sensor 32 provided on the front door D (S12 (outing motion detecting step)). If the outing motion detecting section 22 detects that the user has left home (YES in S12), the human body sensor confirming section 23 judges whether or not all of the human body sensors 31 are OFF (S13 (initial state detecting step)). Note that the steps S12 and S13 may be performed in an inverse order.

Subsequently, if the human body sensor confirming section 23 judges that all of the human body sensors 31 are OFF (YES in S13), the security system 1A is put on hold for a predetermined period of time in order to confirm that the condition is stable (S16), and then the mode switching reminder section 24 sends the mode change reminder information to the remote alarm device 40 (S17). Incidentally, the steps S17 and S18 correspond to the mode switching reminder step.

Upon receiving the mode change reminder information, the remote alarm device 40 causes the reminder information presenting section 41 to present the information to the user (S18). The remote alarm device 40 then receives approval for or objection to the setting of the alert mode through the switch instruction input section 42, and transmits the response to the mode change reminder information to the home controller 10 (Sl9).

In the home controller 10, the mode switching reminder section 24 receives the response from the remote alarm device 40. If the response is an instruction to switch to the alert mode (YES in S20), the mode switching reminder section 24 requests the mode switching section 21 to switch the mode (S21 (mode switching step)).

In this manner, when the outing motion detection sensors 32 detect that the user has left home and the human body sensors 31 do not detect the presence of any other users, the security system 1A judges that the user has forgotten to set the alert mode, and sends, to the remote alarm device 40, the mode change reminder information in order to advice the user to set the alert mode. Upon receiving this information, the user replies, to the home controller 10, whether or not the alert mode is set.

If the reply from the user indicates that the switching to the alert mode is necessary, the home controller 10 causes the alarm generating section 13 to shift to the alert mode. If the reply from the user indicates that the switching to the alert mode is unnecessary, the home controller 10 finishes the process without the shift to the alert mode.

Next, the outing motion detecting step (S12) of detecting the outing motion of the user will be specifically discussed in reference to FIG. 5. FIG. 5 is an explanatory diagram illustrating a concrete example of the detection states of the outing motion detection sensors provided in the security system 1A illustrated in FIG. 3.

In general, the user regularly takes sequential actions at the time of leaving the house (the monitored area A). Taking this into account, as the outing motion detecting step, the outing motion detecting section 22 identifies these sequential actions for the outing, on ground of the flow of detection results of the outing motion detection sensors 32. More specifically, as illustrated in FIG. 5, the outing motion detecting section 22 checks whether or not the following sequential changes of the states occur: the human body sensor SA1 at the entrance turns ON→the front door D "OPEN" (i.e. the open-close detection sensor SA2 turns ON)→the human body sensor SA3 outside the front door D turns ON.

It is noted that the outing motion detecting section 22 stores the detection signals supplied from the outing motion detection sensor 32, each time the states vary. On this account, the times in FIG. 5 are not necessarily at fixed intervals.

As described above, the outing motion detection sensors 32 detect to which direction the user moves. For this reason, the outing motion detection sensors 32 may be composed of any two of the human body sensors SA1 and SA3 and the open-close detection sensor SA2 on the front door D. However, the number of the outing motion detection sensor 32 is preferably three, from the view point of accuracy. Incidentally, if the monitored area A has more than one exit (e.g. a kitchen door is additionally provided), such an additional exit is also provided with the outing motion detection sensors 32.

If the sequence of the changes of the detection signals, which are supplied from the respective outing motion detection sensors 32 corresponding to the outing motion of the user, has been unknown, the changes of the detection signals within a predetermined period after the user sets the alert mode by the setting input section 15 of the home controller 10 are set as the sequence corresponding to the outing motion of the user, by the outing motion detecting section 22. For instance, in FIG. 2, at the time of leaving home, the user operates the home controller 10 in the four-and-a-half-mat Western-style room so as to set the alert mode, and then moves to the entrance and goes out through the front door D. Accordingly, as illustrated in FIG. 5 for example, the outing motion detecting section 22 stores the states of the detection signals that are supplied from the outing motion detection sensors 32 during the aforesaid actions of the user, as reference data for detecting the outing motion of the user. It is noted that the study of the history is helpful for determining the reference data, as in the below-mentioned case of the sensor state accumulating section 25.

As described above, the security system 1 illustrated in FIG. 3 includes (i) the security sensors 33 that detect an abnormality in the monitored area A and (ii) the home controller 10 that performs the predetermined coping action when the security sensors 33 detect the abnormality, and further includes (iii) the outing motion detection sensors 32 that detect the actions of the user at the time of going out from the monitored area A and (iv) the human body sensors 31 that detect the existence of the user in the monitored area A. Moreover, the home controller 10 includes (I) the mode switching section 21 that switches between the alert mode with which the coping action is performed if the security sensors 33 detect the abnormality and the non-alert mode with which the coping action is not performed, and (II) the mode switching reminder section 24 that causes the remote alarm device 40 located at a remote place to present the mode change reminder information indicating the following case: the outing motion detection sensors 32 detect that the user has left home, the human body sensors 31 do not detect the presence of any other users, and the non-alert mode has been set.

With this arrangement, the mode change reminder information is presented by the remote alarm device 40 in the case where the outing motion detection sensors 32 detect that the user has left home, the human body sensors 31 do not detect the presence of any other users, and the non-alert mode has been set. In this manner, the user of the security service is advised to switch to the alert mode. On this account, the absence of security measures caused by a human error can be prevented, and hence the level of security can be significantly improved.

Now, the security system 1B illustrated in FIG. 6 will be discussed. This security system 1B is provided with a mode control section 20B which is identical with the mode control section 20 (FIG. 1), except that the human body sensor confirming section 23, the sensor state accumulating section 25, and the storage section 26 are not provided therein. The security system 1B does not require the human body sensors 31, and the detection of intrusion is performed by the security sensors 33 that also function as human body sensors.

Figure 6:
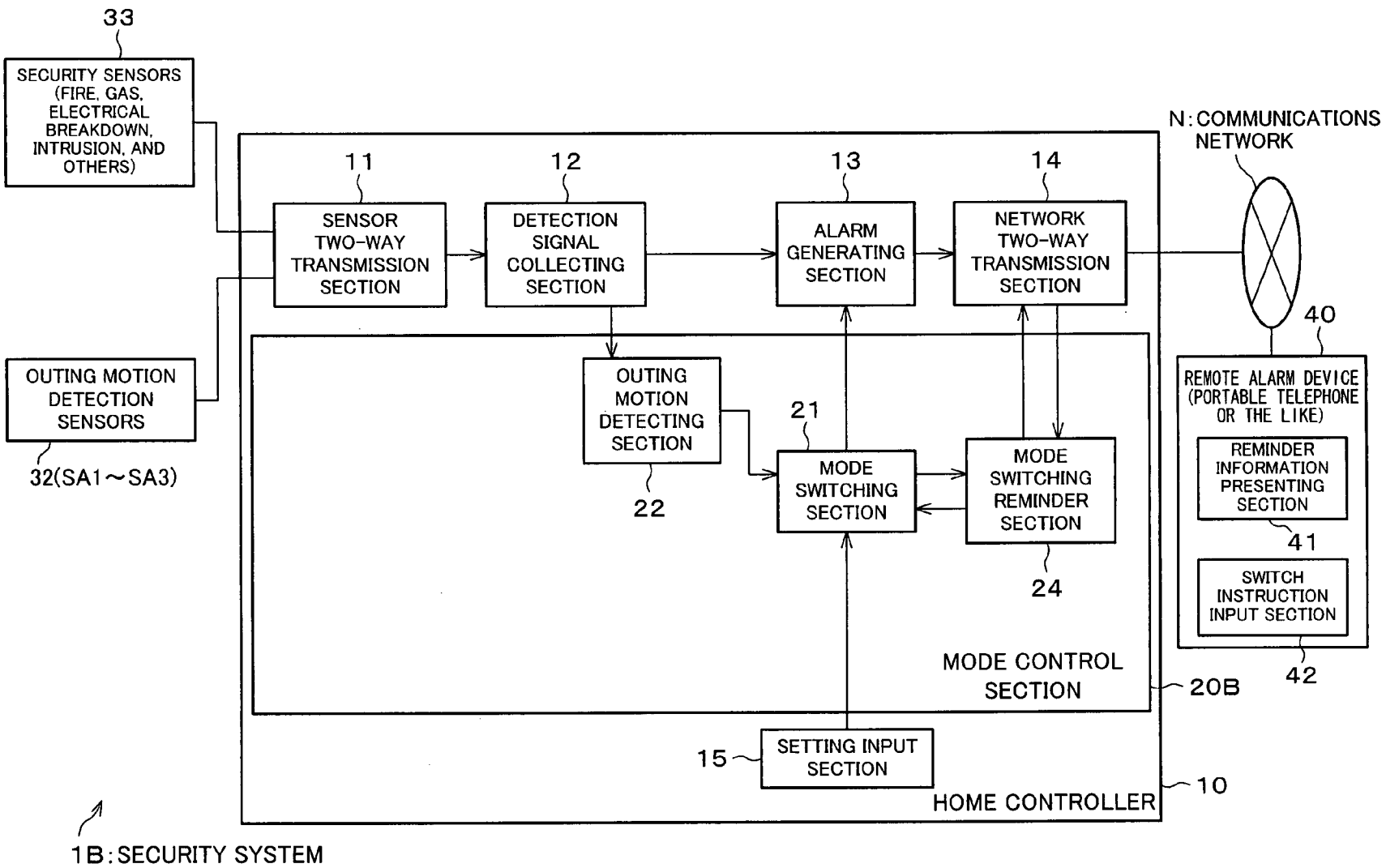
FIG. 6 is a functional block diagram of another alternative example of the security system illustrated in FIG. 1.

The security system 1 illustrated in FIG. 6 includes (i) the security sensors 33 that detect an abnormality in the monitored area A, (ii) the home controller 10 that performs a predetermined coping action when the security sensors 33 detect the abnormality, and (iii) the outing motion detection sensors 32 that detect the actions of the user at the time of going out from the monitored area A, and the home controller 10 includes (I) the mode switching section 21 that switches between the alert mode with which the coping action is performed if the security sensors 33 detect the abnormality and the non-alert mode with which the coping action is not performed, and (II) the mode switching reminder section 24 that causes the remote alarm device 40 located at a remote place to present the mode change reminder information in the case when the outing motion detection sensors 32 detect that the user has left home and the non-alert mode has been set.

With this arrangement, when the outing motion detection sensors 32 detect that the user has left home and the non-alert mode has been set, the mode change reminder information is presented by the remote alarm device 40, thereby advising the user of the security service to switch to the alert mode. This makes it possible to prevent the occurrence of the absence of security measures caused by a human error, and hence the level of security is significantly improved.

Now, the security system 1C illustrated in FIG. 7 will be discussed. The security system 1C is provided with a mode control section 20C that is identical with the mode control section 20 (FIG. 1) except that the outing motion detecting section 22, the sensor state accumulating section 25, and the storage section 26 are not provided. This security system 1C does not require the outing motion detection sensors 32. The detection of the intrusion through the front door D is detected by the security sensors 33 that also function as human body sensors.

Figure 7:
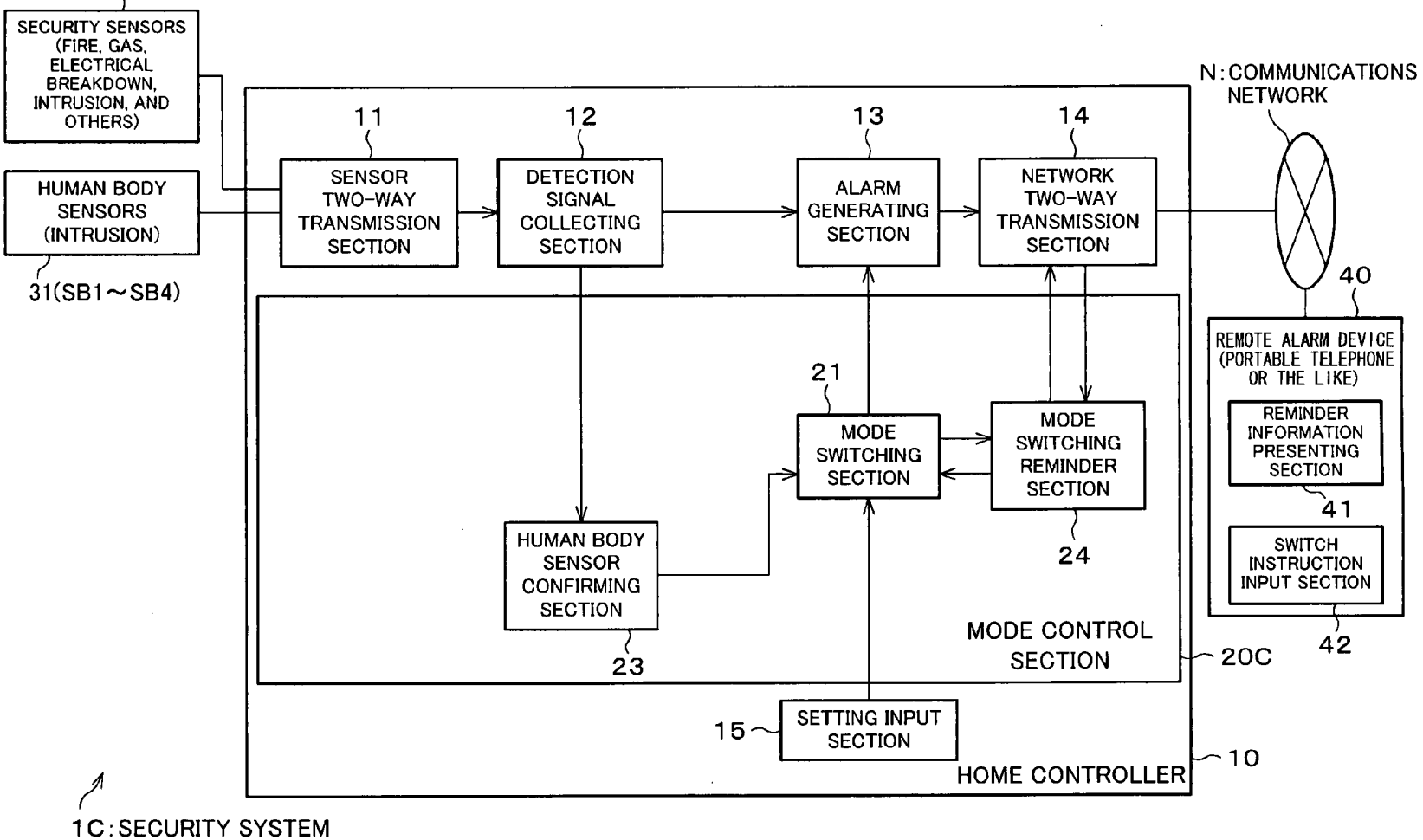
FIG. 7 is a functional block diagram of a further alternative example of the security system illustrated in FIG. 1.

The security system 1 illustrated in FIG. 7 includes (i) the security sensors 33 that detect an abnormality in the monitored area A, (ii) the home controller 10 that performs a predetermined coping action when the security sensors 33 detect the abnormality, and (iii) the human body sensors 31 that detect the existence of the user in the monitored area A, and the home controller 10 includes (I) the mode switching reminder section 24 that switches between the alert mode with which the coping action is performed if the security sensors 33 detects the abnormality and the non-alert mode with which the coping action is not performed, and (II) the mode switching reminder section 24 that causes the remote alarm device 40 located at a remote place to present the mode change reminder information in the case when the human body sensors 31 do not detect the presence of any other users and the non-alert mode has been set.

With this arrangement, when the human body sensors 31 do not detect the user and the non-alert mode has been set, the mode change reminder information is presented by the remote alarm device 40, thereby advising the user of the security service to switch to the alert mode. On this account, the occurrence of the absence of security measures caused by a human error can be prevented, and the level of security can be significantly improved.

Next, the sensor state accumulating section 25 and the storage section 26 of the security system 1, illustrated in FIG. 1, will be discussed.

As already described in relation to the security system 1A (FIG. 3) and the security system 1C (FIG. 7), if the human body sensor confirming section 23 confirms that all of the human body sensors 31 are OFF, it is confirmed that the user has left the monitored area A.

In the security system, however, the monitored area A is not always unmanned even if the security mode is set. Also, the sensors may be of poor maintenance. By the way, it has generally been said that security systems are often accompanied with false alarm. For these reasons, whether or not the user has left the monitored area may not be properly determined if the determination sorely depends on the check of the (OFF) states of the human body sensors 31.

Therefore, the security system 1 learns the detection states of the human body sensors 31 at the time of user's setting the alert mode. More specifically, as illustrated in FIG. 9, the security system 1 generates the sensor state accumulative data 26*a* in which the detection states (initial states) of the human body sensors 31 at the time of switching to the alert mode are associated with the accumulative frequencies of the detection states. With this data, the security system in the non-alert mode judges that the user has left home without setting the alert mode, when a pattern of the detection states of the human body sensors 31 is matched with a high accumulative frequency pattern of the initial states. It is noted that the accumulative frequency of the detection states indicates how often the user set the alert mode in a pattern including those detection states.

The following will specifically describe the sensor state accumulative storing process.

Upon receiving the instruction to switch to the alert mode, the sensor state accumulating section 25 edits the sensor state accumulative data 26*a*. In doing so, the detection states of the human body sensors 31, at the time of receiving the instruction or after a predetermined period has elapsed from the arrival of the instruction, are set as the aforesaid initial states. Then, the sensor state accumulating section 25 stores the sensor state accumulative data 26*a* in the storage section 26. On this occasion, if the aforesaid pattern of the detection states has already been stored in the sensor state accumulative data 26*a*, the sensor state accumulating section 25 increments by 1 with respect to the accumulative frequency of that pattern of the detection states. Meanwhile, if the aforesaid pattern of the detection states is not stored in the sensor state accumulative data 26*a*, the aforesaid pattern is added to the sensor state accumulative data 26*a*, and the frequency of this pattern is set to "1". Note that, as described above, the mode switching instruction may be inputted through the setting input section 15 or may be supplied from the remote alarm device 40.

It is also noted that, during the aforesaid predetermined time, the system is put on hold until the detection states of the human body sensors 31 are stabilized. This time is, for instance, a time during which the user is supposed to go through the front door D (exit of the monitored area) and leave the monitored area A, after switching the mode using the home controller 10 provided in the monitored area A. On this account, depending on the locations of the human body sensors 31, the detection states may be stored simultaneously with the switching to the alert mode.

The storage section 26 is, for instance, a nonvolatile memory, and stores the sensor state accumulative data 26*a* indicating the initial states of the human body sensors 31 in the alert mode, as described above.

The human body sensor confirming section 23 compares a pattern of the detection states of the human body sensors 31 with highest accumulative frequency patterns, the number of which is predetermined, registered in the sensor state accumulative data 26*a*, so as to detect a matching therebetween. Note that the human body sensor confirming section 23 may compare the detection states with all of the patterns registered in the sensor state accumulative data 26*a*. That is to say, in some cases, if a pattern of the detection states is matched with the pattern with which the alert mode was set for once (i.e. the accumulative frequency is at least 1), it may be judged that there is a possibility that the user has left home without switching to the alert mode.

Figure 8:
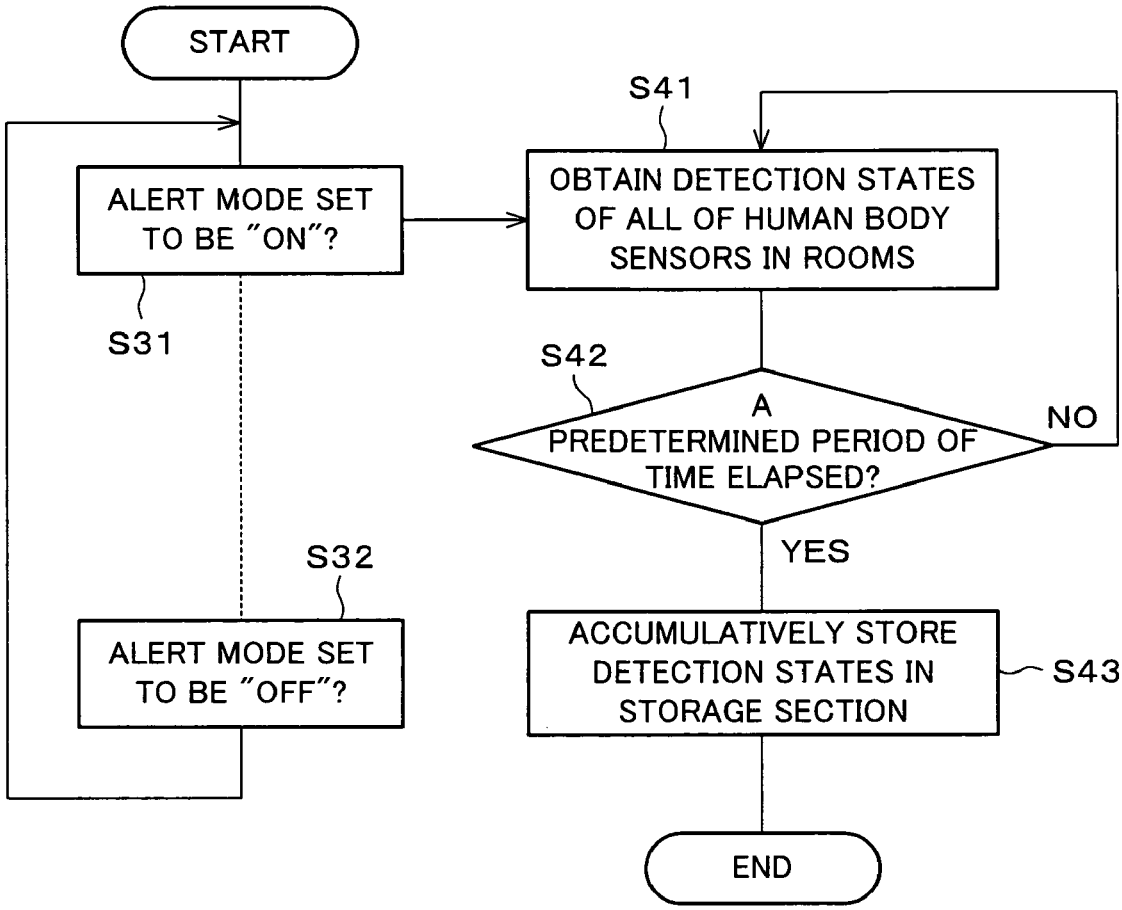
FIG. 8 is a flowchart illustrating a sensor state accumulative storing process of the security systems illustrated in FIGS. 1 and 11.
Figure 11:
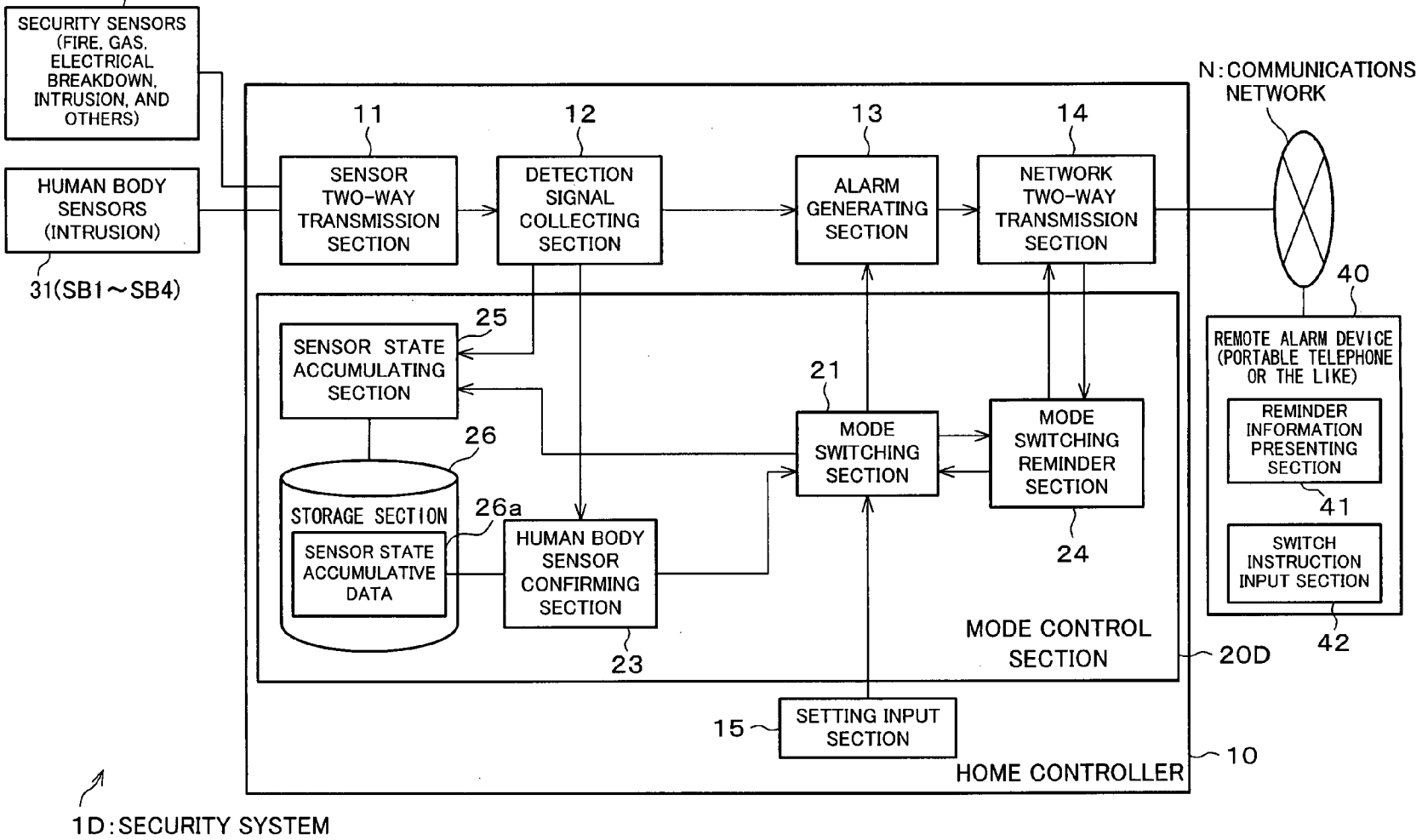
FIG. 11 is a functional block diagram illustrating yet another alternative example of the security system illustrated in FIG. 1.

FIG. 8 is a flowchart illustrating the sensor state accumulative storing process of the security systems illustrated in FIGS. 1 and 11.

First, when the user sets the alarm mode through the home controller 10 or the remote alarm device 40 (S31), the mode switching section 21 notifies the sensor state accumulating section 25 of the switching to the alert mode. Subsequently, the sensor state accumulating section 25 obtains the detection states of all of the human body sensors 31 in the house via the detection signal collecting section 12, within a predetermined period of time, so that the sensor state accumulating section 25 determines the detection states after the predetermined period of time has elapsed from the setting of the alarm mode (S41 and S42). Then the sensor state accumulating section 25 registers the pattern of the determined detection states to the sensor state accumulative data 26*a*, increments by 1 with respect to the accumulative frequency of that pattern, and stores the determined detection states to the sensor state accumulative data 26*a* in the storage section 26 (S43).

It is noted that, during the predetermined time in the step S42, the system is put on hold in order to allow the user to go out through the front door D after setting the alert mode using the home controller 10. If the non-alert mode is set again during the predetermined time (S32), the process finishes without registering the pattern of the detection states. This step assumes such a case that the user steps outside for a short period of time, for example, to take a delivered newspaper.

FIG. 9 is an explanatory diagram illustrating a concrete example of the sensor state accumulative data of the security system 1 illustrated in FIG. 1.

As illustrated in FIG. 9, in the sensor state accumulative data 26*a*, the patterns of the detection states of the human body sensors 31 on occasions that the user sets the alert mode are registered, with the accumulative frequencies of those patterns. In the example of FIG. 9, the detection states of all of the human body sensors 31 are OFF in Pattern 0. It is noted that, although the human body sensor SA1 at the entrance mainly functions as the outing motion detection sensor 32, the detection states of the human body sensor SA1 which functions as the human body sensors 31 may be registered as illustrated in FIG. 9. In the situation illustrated in FIG. 9, if the detection states of the human body sensors 31 when the user set the alarm mode correspond to Pattern 1, the accumulative frequency of Pattern 1 is updated to "31".

The user typically activates the security system 1 on the occasion of leaving home, so that the user sets the alert mode in such an occasion. On this account, the detection states of the human body sensor 31 in the alert mode are identical with the detection states when the user surely sets the alert mode. Also, a pattern of the detection states of the human body sensors 31 is closely related to the alert mode, on condition that the pattern is identical with the pattern of the detection states at the time of the switch to the alert mode. In other words, a high accumulative frequency pattern of the detection states is likely to be a pattern in the alert mode. Therefore, the accumulative frequencies of the patterns of the detection states of the human body sensors 31 when the user surely sets the alert mode are obtained, and as a result of judgment from the obtained accumulative frequencies, it is possible to certainly recognize whether or not the alert mode has been set, from the detection states of the human body sensors 31.

Figure 10:
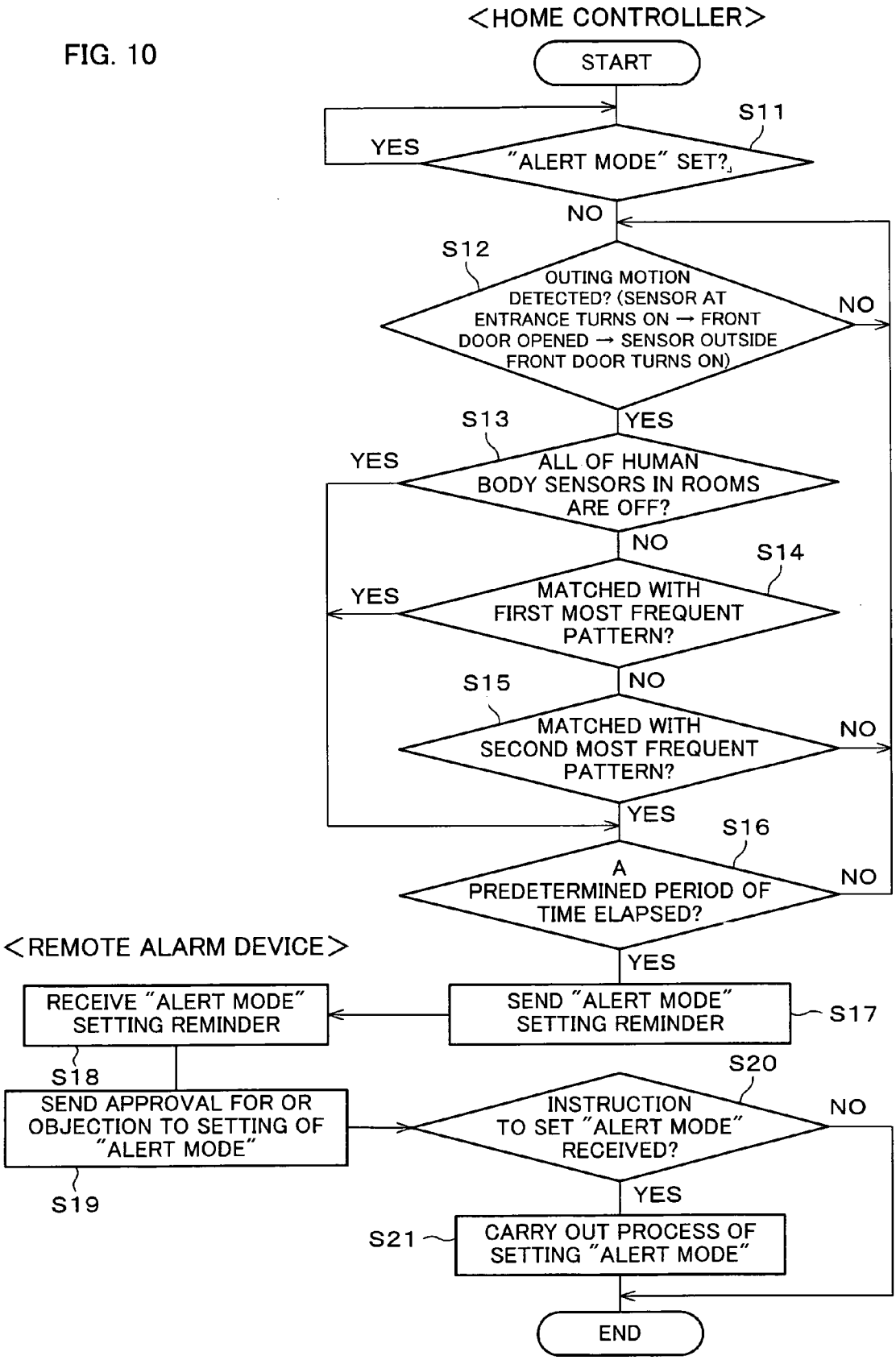
FIG. 10 is a flowchart illustrating how the security system illustrated in FIG. 1 operates.

FIG. 10 is a flowchart illustrating how the security system 1 illustrated in FIG. 1 operates. In the flowchart in FIG. 10, the steps of checking a matching with high accumulative frequent patterns of the detection states of the human body sensors 31 in the alert mode in the past are added to the steps in the flowchart illustrated in FIG. 4, so that the reliability of the system is further improved. More specifically, the steps of checking the matching with Pattern 1 and Pattern 2 (which are first and second high accumulative frequency patterns except Pattern 0 with which all of the human body sensors are OFF) are added to the flowchart illustrated in FIG. 4 (i.e. S13 and S14 (initial state detecting steps) are added). As a matter of course, one can suitably decide up to what number-th pattern the matching is checked. For this reason, the matching may be checked only with respect to the first high accumulative frequency pattern, or the matching may be checked with respect to all of the accumulative frequency patterns.

With this, the initial states of the human body sensors 31, not limited to the initial states in which the human body sensors 31 are all OFF, can be flexibly detected. On this account, it is possible to increase the reliability of the decision of whether or not the mode change reminder information should be sent in order to advice the user to switch to the alert mode.

Note that, at the initial use of the security system 1, not many patterns of the detection states of the human body sensors 31 are accumulated in the system. For this reason, the security system 1 is operated in accordance with the flowchart in FIG. 4 for a start, and after a certain number of the patterns is accumulated, the security system 1 operates in accordance with the flowchart in FIG. 10.

As described above, the security system 1 illustrated in FIG. 1 includes (i) the security sensors 33 that detect an abnormality in the monitored area A, (ii) the home controller 10 that performs a predetermined coping action when the security sensors 33 detect the abnormality, (iii) the outing motion detection sensors 32 that detect the actions of the user at the time of going out from the monitored area A, and (iv) the human body sensors 31 that detect the existence of the user in the monitored area A, and the home controller 10 includes (I) the mode switching section 21 that switches between the alert mode with which the coping action is performed if the security sensors 33 detects the abnormality and the non-alert mode with which the coping action is not performed, (II) the storage section 26 that stores the sensor state accumulative data 26*a* indicating the initial states of the human body sensors 31 in the alert mode, (III) the human body sensor confirming section 23 that compares the detection states of the human body sensors 31 with the sensor state accumulative data 26*a* to detect a matching, and (IV) the mode switching reminder section 24 that causes the remote alarm device 40 located at a remote place to present the mode change reminder information in the case when the outing motion detection sensors 32 detect that the user has left home, the detection states of the human body sensors 31 are matched with the sensor state accumulative data 26*a*, and the non-alert mode has been set.

With this, when the outing motion detection sensors 32 detect that the user of the security service has left home, the detection states of the human body sensors 31 are matched with the sensor state accumulative data 26*a*, and non-alert mode has been set, the mode change reminder information is presented by the remote alarm device 40 so that the user is advised to switch to the alert mode. On this account, the occurrence of the absence of security measures caused by a human error can be prevented, and the level of security can be significantly improved.

Referring to FIG. 11, the security system 1D will be discussed. This security system 1D includes a mode control section 20D which is identical with the mode control section 20 (illustrated in FIG. 1), except that the outing motion detecting section 22 is not provided. In this security system 1D, the outing motion detection sensor 32 is not required. The detection of intrusion through the front door D is performed by the security sensors 33, which function as human body sensors or the like.

The security system 1 illustrated in FIG. 11 includes (i) the security sensors 33 that detect an abnormality in the monitored area A, (ii) the home controller 10 that performs a predetermined coping action when the security sensors 33 detect the abnormality, and (iii) a plurality of the human body sensors 31 that detect the presence of the user in the monitored area A, and the home controller 10 includes (I) the mode switching section 21 that switches between the alert mode with which the coping action is performed if the security sensors 33 detects the abnormality and the non-alert mode with which the coping action is not performed, (II) the storage section 26 that stores the sensor state accumulative data 26*a* indicating the initial states of the human body sensors 31 in the alert mode, (III) the human body sensor confirming section 23 that compares the detection states of the human body sensors 31 with the sensor state accumulative data 26*a*, and (IV) the mode switching reminder section 24 that causes the remote alarm device 40 located at a remote place to present the mode change reminder information in the case when the detection states of the human body sensors 31 are matched with the sensor state accumulative data 26*a*, and the non-alert mode has been set.

With this, when the detection states of the human body sensors 31 are matched with the sensor state accumulative data 26*a* and the non-alert mode has been set, the mode change reminder information is presented by the remote alarm device 40, thereby advising the user to switch to the alert mode. On this account, the occurrence of the absence of security measures caused by a human error can be prevented, and the level of security can be significantly improved.

As described above, the security system 1 can decide when the alert mode should be set, in accordance with: (i) the detection of the outing motion of the user by the outing motion detection sensor 32; (ii) confirmation that the detection states of all of the human body sensors 31 are OFF; and (iii) comparison between the current detection states of the human body sensors 31 and the detection states of the human body sensors 31 when the user surely set the alert mode in the past. On this account, when such a human error that the user has left home without setting the alert mode occurs, the security system 1 can advise the user to set the alert mode. The reliability of the security system is therefore significantly improved.

Furthermore, the security system 1 is arranged such that the mode change reminder information is sent to the user so that the system is switched to the alert mode in accordance with the decision and response of the user. When the user does not wish to set the alert mode due to any particular reasons, the system is not switched to the alert mode. In this manner, the system can be flexibly operated.

As described above, the security system 1 can always support the user who forgot to set the alert mode, without imposing a burden on the user. In this manner, in this security system the user and the system complement each other.

Moreover, the security system 1 does not require a large number of sensors for sending the mode change reminder information, and the process for sending the information is simple. On this account, the security system 1 is small in size and its manufacturing costs are low. Moreover, the security sensors 33 can be used as the human body sensors 31 and the outing motion detection sensor 32. In other words, the sensors that are not used in the non-alert mode are effectively utilized for another purpose.

The embodiment being thus described does not impose any limit on the present invention, and it will be obvious that the same way may be varied in many ways within the scope of the present invention. For instance, the present invention may be arranged as follows.

For example, the mode switching section 21 preferably switches automatically to the alert mode, when the mode switching reminder section 24 fails to send the mode change reminder information to the remote alarm device 40, or when the remote alarm device 40 does not reply to the mode switching reminder section 24 within a predetermined period of time after the mode change reminder information was sent to the remote alarm device 40. In these cases, the report of the switch may be supplied from the mode switching reminder section 24 to the remote alarm device 40.

When the conditions on which the mode change reminder information is sent to the user are met, the mode switching section 21 may automatically switch to the alert mode instead of causing the mode switching reminder section 24 to send the mode change reminder information.

More specifically, the mode switching section (mode switching means) 21 in the non-alert mode may automatically switch to the alert mode (automatic switching process), (1) when the outing motion detection sensor 32 detects that the user has left home, (2) when the detection states of the human body sensors 31 are matched with the initial states stored as the sensor state accumulative data 26*a* in the storage section 26, or (3) when the outing motion detection sensor 32 detects that the user has left home, and the detection states of the human body sensors 31 are matched with the initial states. In short, the security system 1 may automatically switch to the alert mode without advising the user to do so.

If automatically switching to the alert mode as described above, the mode switching section 21 may cause the mode switching reminder section 24 to send mode change report information indicating the switching to the alert mode to the remote alarm device 40, so as to cause the remote alarm device 40 to present, to the user, the report of the automatic switch. Moreover, it is possible to adopt such an arrangement that, as a response to the mode change report information, the remote alarm device 40 outputs an approval of or objection to the automatic switch, and the mode switching section 21 controls the mode in line with the response.

When the mode switching section 21 receives the approval of the automatic switch from the user, the sensor state accumulating section 25 may register the pattern of the detection states of the human body sensors 31 at the time of the automatic switch to the sensor state accumulative data 26*a* and stores it in the storage section 26, after incrementing by "1" with respect to the accumulative frequency of that pattern.

Also, as the remote alarm device 40, a fixed alarm box may be provided. If such an alarm box is provided on a path from the entrance to the gate, it is possible to advice the user on the path to set the alarm by means of warning sound and light, even if the user does not carry a mobile phone and the like. Since the alarm box is provided outside of the house, the warning message is preferably encrypted.

Instead of providing the human body sensors, the user may carry a communicator that outputs a registered signal. In this case, the existence of the user is detected by receiving this signal.

The blocks of the security system 1, i.e. the home controller 10 and the remote alarm device 40, may be realized by hardware logic, or may be realized by software by means of a CPU.

That is, each of the home controller 10 and the remote alarm device 40 includes: a CPU (Central Processing Unit) executing the order of a control program that is software for realizing the aforesaid functions; a storage device (storage medium) such as a ROM (Read Only Memory) that stores the control program and various types of data; a RAM (Random Access Memory) for spreading out the control program, and the like. With this arrangement, the objective of the present invention is realized in the following manner: a storage medium in which program codes (e.g. an executable code program, intermediate code program, and source program) are stored in a computer-readable manner are supplied to the home controller 10 and the remote alarm device 40, and the computer (or CPU, MPU) reads out the program codes from the storage medium and executes the same. In this case, the program codes read out from the storage medium realize the aforesaid functions.

The storage medium for supplying the program codes may be tape based, such as a magnetic tape or cassette tape; disc based, including a magnetic disc such as a floppy® disc or hard disk and an optical disc such as CD-ROM/MO/MD/DVD/CD-R; card based, including an IC card (including a memory card) and an optical card; or a semiconductor memory, such as a mask ROM, EPROM (Erasable Programmable Read Only Memory), EEPROM (Electrically Erasable Programmable Read Only Memory), and a flash ROM.

Alternatively, the program codes may be supplied to the home controller 10 and the remote alarm device 40 via the communications network N. Nonexclusive examples of the communication network includes the Internet, intranet, extranet, LAN, ISDN, VAN, CATV communication network, virtual private network, telephone network, mobile communication network, and satellite communication network. Nonexclusive examples of transmission media constituting the communications network N are cables such as IEEE1394, USB, power-line carrier, cable TV lines, telephone lines, ADSL lines, and wireless connections such as IrDA and remote control using infrared light, Bluetooth®, 802.11, HDR, mobile phones, satellite connections, and terrestrial digital broadcasting.

As described above, the security system of the present invention may be arranged so as to include: a control device for performing a predetermined coping action when an abnormality is detected in a monitored area; an outing motion detection sensor for detecting actions of a non-monitored person leaving the monitored area; and a non-monitored person detecting sensor for detecting the non-monitored person in the monitored area, the control device including: mode switching means for switching between an alert mode with which the coping action is performed if the abnormality is detected in the monitored area and a non-alert mode with which the coping action is not performed; and mode switching reminder means for causing a remote alarm device located at a remote place to present mode change reminder information, when the outing motion detection sensor detects that the non-monitored person has left the monitored area, the non-monitored person detecting sensor does not detect any other non-monitored person, and the non-alert mode has been set.

In this specification, "non-monitored person" indicates a non-intruder whose presence is not seen as an abnormality. Meanwhile, "user" is a person who switches between the non-alert mode and the alert mode. In short, "user" is a sort of an administrator of the security system. If the monitored area is, for instance, a typical house, "non-monitored person" and "user" are both inhabitants of the house, and hence "non-monitored person" and "user" are often the same person. On the contrary, if the monitored area is, for instance, a commercial building having tenants, these tenants as well as the administrator are "non-monitored persons". On this account, "non-monitored person" is often different from "user". Furthermore, in the security system of this scale, "user" may not enter the monitored area while the non-alert mode is set.

With this arrangement, when the outing motion detection sensor detects that a non-monitored person has left the area, the non-monitored person detecting sensor does not detect the presence of any other user, and the non-alert mode has been set, it is possible to advise the user of the security service to switch to the alert mode by causing the remote alarm device to present the mode change reminder information. With this, the occurrence of the absence of security measures caused by a human error can be prevented, and the level of security can be significantly improved.

It is noted that the timings at which the mode switching means switches the mode are, for instance, as follows: when the user in the monitored area instructs to switch the non-alert mode to the alert mode, before leaving the area; when the user who is outside the monitored area and has received the mode reminder information instructs to switch the mode by means of, for instance, the remote alarm device; and when the mode switching means automatically switches to the alert mode because a certain condition, such as a reply to the mode reminder information having been sent has not returned, is met.

Further, a security system of the present invention may be arranged so as to include: a control device for performing a predetermined coping action when an abnormality is detected in a monitored area; an outing motion detection sensor for detecting actions of a non-monitored person when leaving the monitored area; and a plurality of non-monitored person detecting sensors for detecting the non-monitored person in the monitored area, the control device including: mode switching means for switching between an alert mode with which the coping action is performed if the abnormality is detected in the monitored area and a non-alert mode with which the coping action is not performed; a storage section for storing initial state data that indicates initial states of the non-monitored person detecting sensors in the alert mode; initial state detection means for detecting a matching between detection states of the non-monitored person detecting sensors and the initial state data; and mode switching reminder means for causing a remote alarm device located at a remote place to present mode change reminder information, when the outing motion detection sensor detects that the non-monitored person has left the monitored area, the detection states of the non-monitored person detecting sensors are matched with the initial state data, and the non-alert mode has been set.

With this arrangement, when the outing motion detection sensor detects that the non-monitored person has left the area, the detection states of the non-monitored person detecting sensors are matched with the initial state data, and the non-alert mode has been set, it is possible to advise the user of the security service to switch to the alert mode by causing the remote alarm device to present the mode change reminder information. With this, the occurrence of the absence of security measures caused by a human error can be prevented, and the level of security can be significantly improved.

Still further, a security system of the present invention may be arranged so as to include: a control device for performing a predetermined coping action when an abnormality is detected in a monitored area; and an outing motion detection sensor for detecting actions of a non-monitored person when leaving the monitored area, the control device including: mode switching means for switching between an alert mode with which the coping action is performed if the abnormality is detected in the monitored area and a non-alert mode with which the coping action is not performed; and mode switching reminder means for causing a remote alarm device located at a remote place to present mode change reminder information, when the outing motion detection sensor detects that the non-monitored person has left the monitored area, and the non-alert mode has been set.

With this arrangement, when the outing motion detection sensor detects that the non-monitored person has left the area, and the non-alert mode has been set, it is possible to advise the user of the security service to switch to the alert mode by causing the remote alarm device to present the mode change reminder information. With this, the occurrence of the absence of security measures caused by a human error can be prevented, and the level of security can be significantly improved.

Yet further, the security system of the present invention may be such that the outing motion detection sensor is provided so as to detect actions of the non-monitored person who passes an exit of the monitored area from the inside of the monitored area to the outside.

With this arrangement, it is further possible to reliably detect that the non-monitored person has left the monitored area. For example, the present invention may be arranged such that the human body sensor is provided at the entrance, the open-close detection sensor is provided on the front door, and the human body sensor is provided outside the front door.

Further, a security system of the present invention may be arranged so as to include: a control device for performing a predetermined coping action when an abnormality is detected in a monitored area; and a non-monitored person detecting sensor for detecting the non-monitored person in the monitored area, the control device including: mode switching means for switching between an alert mode with which the coping action is performed if the abnormality is detected in the monitored area and a non-alert mode with which the coping action is not performed; and mode switching reminder means for causing a remote alarm device located at a remote place to present mode change reminder information, when the non-monitored person detecting sensor detects no non-monitored person, and the non-alert mode has been set.

With this arrangement, when the non-monitored person detecting sensor detects no non-monitored person, and the non-alert mode has been set, it is possible to advise the user of the security service to switch to the alert mode by causing the remote alarm device to present the mode change reminder information. With this, the occurrence of the absence of security measures caused by a human error can be prevented, and the level of security can be significantly improved.

Still further, a security system of the present invention may be arranged so as to include: a control device for performing a predetermined coping action when an abnormality is detected in a monitored area; and a plurality of non-monitored person detecting sensors for detecting the non-monitored person in the monitored area, the control device including: mode switching means for switching between an alert mode with which the coping action is performed if the abnormality is detected in the monitored area and a non-alert mode with which the coping action is not performed; a storage section for storing initial state data that indicates initial states of the non-monitored person detecting sensors in the alert mode; and initial state detection means for detecting a matching between detection states of the non-monitored person detecting sensors and the initial state data; and mode switching reminder means for causing a remote alarm device located at a remote place to present mode change reminder information, when the detection states of the non-monitored person detecting sensors are matched with the initial state data, and the non-alert mode has been set.

With this arrangement, when the detection states of the non-monitored person detecting sensors are matched with the initial state data, and the non-alert mode has been set, it is possible to advise the user of the security service to switch to the alert mode by causing the remote alarm device to present the mode change reminder information. With this, the occurrence of the absence of security measures caused by a human error can be prevented, and the level of security can be significantly improved.

Yet further, a security system of the present invention may be arranged such that the control device further includes initial state data accumulative storing means for, when switching to the alert mode is carried out in accordance with an instruction from a user, storing, in the storage section, the initial state data in which the detection states of the non-monitored person detecting sensors at the time of the switching to the alert mode or after a predetermined period has elapsed from the switching to the alert mode are associated with the accumulative frequencies of the detection states, and the initial state detection means compares a pattern of the detection states of the non-monitored person detecting sensors with highest accumulative frequency patterns, the number of which is predetermined, in the initial state data stored in the storage section, so as to detect a matching.

With this arrangement, the detection states of the non-monitored person detecting sensors in the alert mode are identical with the detection states when the user surely sets the alert mode. Also, a pattern of the detection states of the non-monitored person detecting sensors is closely related to the alert mode, on condition that the pattern is identical with the pattern of the detection states at the time of the switch to the alert mode. In other words, a high accumulative frequency pattern of the detection states is likely to be those in the alert mode. Therefore, the accumulative frequencies of the patterns of the detection states of the non-monitored person detecting sensors when the user surely sets the alert mode are obtained, and as a result of judgment from the obtained accumulative frequencies, it is possible to certainly recognize whether or not the alert mode has been set, from the detection states of the non-monitored person detecting sensors.

It is also noted that, during the aforesaid predetermined time after the switching, the system is put on hold until the detection states of the non-monitored person detecting sensors are stabilized. This time is, for instance, a time during which the user is supposed to go through the exit of the monitored area and leave the monitored area, after switching the mode using the control device provided in the monitored area. On this account, depending on the locations of the non-monitored person detecting sensors, the detection states may be stored simultaneously with the switching to the alert mode. Moreover, the instruction to switch to the alert mode by the user may be inputted through either the control device or the remote alarm device.

With this, the initial states of the non-monitored person detecting sensors, not limited to the initial states in which the non-monitored person detecting sensors are all OFF, can be flexibly detected. On this account, it is possible to increase the reliability of the decision of whether or not the mode change reminder information should be sent in order to advice the user to switch to the alert mode.

Further, the security system of the present invention may be arranged such that the remote alarm device includes remote-switching instruction input means for the user inputting a mode switching instruction to the alert mode, and the mode switching means of the control device switches to the alert mode in accordance with the mode switching instruction received from the remote alarm device.

With this arrangement, even if the user leaves home without switching to the alert mode, the user away from home can carry out switching to the alert mode in response to the presentation of mode change reminder information through the remote alarm device.

Still further, a security system of the present invention may be arranged so as to include: a control device for performing a predetermined coping action when an abnormality is detected in a monitored area; an outing motion detection sensor for detecting actions of a non-monitored person when leaving the monitored area; and a non-monitored person detecting sensor for detecting the non-monitored person in the monitored area, the control device including: mode switching means for switching between an alert mode with which the coping action is performed if the abnormality is detected in the monitored area and a non-alert mode with which the coping action is not performed, the mode switching means automatically switching to the alert mode when the outing motion detection sensor detects that the non-monitored person has left the monitored area, the non-monitored person detecting sensor does not detect any other non-monitored person, and the non-alert mode has been set.

With this arrangement, when the outing motion detection sensor detects that the non-monitored person has left the monitored area, the non-monitored person detecting sensor does not detect any other user, and the non-alert mode has been set, the security system can automatically switch to the alert mode without the instruction to switch to the alert mode from the user of the security service. With this, the occurrence of the absence of security measures caused by a human error can be prevented, and the level of security can be significantly improved.

Yet further, a security system of the present invention may be arranged so as to include: a control device for performing a predetermined coping action when an abnormality is detected in a monitored area; and an outing motion detection sensor for detecting actions of a non-monitored person when leaving the monitored area; the control device including: mode switching means for switching between an alert mode with which the coping action is performed if the abnormality is detected in the monitored area and a non-alert mode with which the coping action is not performed, the mode switching means automatically switching to the alert mode when the outing motion detection sensor detects that the non-monitored person has left the monitored area, and the non-alert mode has been set.

With this arrangement, when the outing motion detection sensor detects that the non-monitored person has left the monitored area, and the non-alert mode has been set, the security system can automatically switch to the alert mode without the instruction to switch to the alert mode from the user of the security service. With this, the occurrence of the absence of security measures caused by a human error can be prevented, and the level of security can be significantly improved.

Further, a security system of the present invention may be arranged so as to include: a control device for performing a predetermined coping action when an abnormality is detected in a monitored area; and a plurality of non-monitored person detecting sensors for detecting the non-monitored person in the monitored area, the control device including: mode switching means for switching between an alert mode with which the coping action is performed if the abnormality is detected in the monitored area and a non-alert mode with which the coping action is not performed; a storage section for storing initial state data that indicates initial states of the non-monitored person detecting sensors in the alert mode; and initial state detection means for detecting a matching between detection states of the non-monitored person detecting sensors and the initial state data, the mode switching means automatically switching to the alert mode, when the detection states of the non-monitored person detecting sensors are matched with the initial state data, and the non-alert mode has been set.

With this arrangement, when the detection states of the non-monitored person detecting sensors are matched with the initial state data, and the non-alert mode has been set, the security system can automatically switch to the alert mode without the instruction to switch to the alert mode from the user of the security service. With this, the occurrence of the absence of security measures caused by a human error can be prevented, and the level of security can be significantly improved.

Still further, the security system of the present invention may be arranged so as to include mode switching report means for causing a remote alarm device located at a remote place to present mode change report information, when the mode switching means automatically switches to the alert mode.

With this arrangement, even if the user leaves home without switching to the alert mode, it is possible for the user to receive, through the remote alarm device, the report that the security system automatically has switched to the alert mode. This brings peace of mind to the user. Note that, user's approval for or objection to the automatic switch may be sent from the remote alert device to the control device.

Further, a control device of the present invention may be a component of the foregoing security system.

Still further, a remote alarm device of the present invention may be a component of the foregoing security system.

The remote alarm device of the present invention is preferably arranged in such a manner that the user never leaves home without the remote alarm device. On this account, the remote alarm device of the present invention is characterized in that it is a portable telephone or the like. Note that, the remote alarm device of the present invention may be a mobile terminal such as a PHS (Personal Handyphone System) or PDA (Personal Digital Assistant). Alternatively, the remote alarm device of the present invention may be integrated with a key for the exit of the monitored area or the like. Alternatively, the remote alarm device of the present invention may be integrated with a remote-key to a car or the like.

A control method for a security system of the present invention may be a control method for a security system which can switch between an alert mode with which a predetermined coping action is performed if the abnormality is detected in a monitored area and a non-alert mode with which the coping action is not performed, the method including: an outing motion detecting step of an outing motion detection sensor detecting actions of a non-monitored person when leaving the monitored area; and a mode switching reminder step of causing a remote alarm device located at a remote place to present mode change reminder information, when the outing motion detection sensor detects that the non-monitored person has left the monitored area, and the non-alert mode has been set.

With this method, when the outing motion detection sensor detects that the non-monitored person has left the area, and the non-alert mode has been set, it is possible to advise the user of the security service to switch to the alert mode by causing the remote alarm device to present the mode change reminder information. With this, the occurrence of the absence of security measures caused by a human error can be prevented, and the level of security can be significantly improved.

Further, a control method for a security system of the present invention may be a control method for a security system which can switch between an alert mode with which a predetermined coping action is performed if the abnormality is detected in a monitored area and a non-alert mode with which the coping action is not performed, the method including: an initial state detecting step of detecting a matching between detection states of a plurality of non-monitored person detecting sensors and initial states of the non-monitored person detecting sensors in the alert mode, the non-monitored person detecting sensors each detecting a non-monitored person in the monitored area; and a mode switching reminder step of causing a remote alarm device located at a remote place to present mode change reminder information, when the detection states of the non-monitored person detecting sensors are matched with the initial states, and the non-alert mode has been set.

With this method, when the detection states of the non-monitored person detecting sensors are matched with the initial state data, and the non-alert mode has been set, it is possible to advise the user of the security service to switch to the alert mode by causing the remote alarm device to present the mode change reminder information. With this, the occurrence of the absence of security measures caused by a human error can be prevented, and the level of security can be significantly improved.

Still further, a control method for a security system of the present invention may be a control method for a security system which can switch between an alert mode with which a predetermined coping action is performed if the abnormality is detected in a monitored area and a non-alert mode with which the coping action is not performed, the method including: an outing motion detecting step of an outing motion detection sensor detecting actions of a non-monitored person when leaving the monitored area; and an automatic switching step of automatically switching to the alert mode when the outing motion detection sensor detects that the non-monitored person has left the monitored area, and the non-alert mode has been set.

With this method, when the outing motion detection sensor detects that the non-monitored person has left the monitored area, and the non-alert mode has been set, the security system can automatically switch to the alert mode without the instruction to switch to the alert mode from the user of the security service. With this, the occurrence of the absence of security measures caused by a human error can be prevented, and the level of security can be significantly improved.

Yet further, a control method for a security system of the present invention may be a control method for a security system which can switch between an alert mode with which a predetermined coping action is performed if the abnormality is detected in a monitored area and a non-alert mode with which the coping action is not performed, the method including: an initial state detecting step of detecting a matching between detection states of a plurality of non-monitored person detecting sensors and initial states of the non-monitored person detecting sensors in the alert mode, the non-monitored person detecting sensors each detecting a non-monitored person in the monitored area; and an automatic switching step of automatically switching to the alert mode, when the detection states of the non-monitored person detecting sensors are matched with the initial states, and the non-alert mode has been set.

With this method, when the detection states of the non-monitored person detecting sensors are matched with the initial state data, and the non-alert mode has been set, the security system can automatically switch to the alert mode without the instruction to switch to the alert mode from the user of the security service. With this, the occurrence of the absence of security measures caused by a human error can be prevented, and the level of security can be significantly improved.

Further, a control program of the present invention is a computer program which causes a computer to function as each of the foregoing means.

With this arrangement, by realizing each of the foregoing means of the security system on a computer, it is possible to realize the control device and the remote alarm device of the security system.

Further, a computer-readable storage medium storing therein the control program of the present invention is a computer-readable storage medium storing the control program which operates the foregoing security system by causing a computer to realize each of the foregoing means.

With this arrangement, the control program read out from the foregoing storage medium realizes the control device and the remote alarm device of the security system on a computer.

Specific embodiments or examples implemented in the description of the embodiments only show technical features of the present invention and are not intended to limit the scope of the invention. Variations can be effected within the spirit of the present invention and the scope of the following claims.

INDUSTRIAL APPLICABILITY

A security system according to the present invention covers for the occurrence of absence of security measures caused by such a human error that the user leaves home without setting the "alert mode", without imposing a burden on the user. Therefore, the present invention is widely applicable to security systems in which security measures are automated by providing security sensors and the like in houses and buildings. That is, the present invention is available for wide variety of security systems ranging from a large-scale system in which a security center receives a security alert from a sensor via a computer network upon the detection of an intruder and the like by the sensor, so that security guard are sent to the scene, to a simple system in which information detected by a sensor is sent to a mobile terminal such as a mobile phone of the user.

The invention claimed is:

1. A security system comprising:

a control device for performing a predetermined coping action when an abnormality is detected in a monitored area;

an outing motion detection sensor for detecting actions of a non-monitored person when leaving the monitored area; and a non-monitored person detecting sensor for detecting the non-monitored person in the monitored area, the control device including:

mode switching means for switching between an alert mode with which the coping action is performed if the abnormality is detected in the monitored area and a non-alert mode with which the coping action is not performed; and mode switching reminder means for causing a remote alarm device located at a remote place to present mode change reminder information, when the outing motion detection sensor detects that the non-monitored person has left the monitored area, the non-monitored person detecting sensor does not detect any other non-monitored person, and the non-alert mode has been set.

2. The security system according to claim 1, wherein:

the remote alarm device includes remote-switching instruction input means for the user inputting a mode switching instruction to the alert mode, and the mode switching means of the control device switches to the alert mode in accordance with the mode switching instruction received from the remote alarm device.

3. A control device being a component of the security system according to claim 1.

4. A remote alarm device being a component of the security system according to claim 1.

5. The remote alarm device according to claim 4 being a portable telephone.

6. The remote alarm device according to claim 4 being integrated with a key for the exit of the monitor area.

7. The remote alarm device according to claim 4 being integrated with a remote-key to a car.

8. A security system comprising:

a control device for performing a predetermined coping action when an abnormality is detected in a monitored area;

an outing motion detection sensor for detecting actions of a non-monitored person when leaving the monitored area; and a plurality of non-monitored person detecting sensors for detecting the non-monitored person in the monitored area, the control device including:

mode switching means for switching between an alert mode with which the coping action is performed if the abnormality is detected in the monitored area and a non-alert mode with which the coping action is not performed;

a storage section for storing initial state data that indicates initial states of the non-monitored person detecting sensors in the alert mode;

initial state detection means for detecting a matching between detection states of the non-monitored person detecting sensors and the initial state data; and mode switching reminder means for causing a remote alarm device located at a remote place to present mode change reminder information, when the outing motion detection sensor detects that the non-monitored person has left the monitored area, the detection states of the non-monitored person detecting sensors are matched with the initial state data, and the non-alert mode has been set.

9. The security system according to claim 8, wherein:

the outing motion detection sensor is provided so as to detect actions of the non-monitored person who passes an exit of the monitored area from the inside of the monitored area to the outside.

10. A security system comprising:

a control device for performing a predetermined coping action when an abnormality is detected in a monitored area; and a plurality of non-monitored person detecting sensors for detecting the non-monitored person in the monitored area, the control device including:

mode switching means for switching between an alert mode with which the coping action is performed if the abnormality is detected in the monitored area and a non-alert mode with which the coping action is not performed;

a storage section for storing initial state data that indicates initial states of the non-monitored person detecting sensors in the alert mode; and initial state detection means for detecting a matching between detection states of the non-monitored person detecting sensors and the initial state data; and mode switching reminder means for causing a remote alarm device located at a remote place to present mode change reminder information, when the detection states of the non-monitored person detecting sensors are matched with the initial state data, and the non-alert mode has been set.

11. The security system according to claim 10, wherein:

the control device further includes initial state data accumulative storing means for, when switching to the alert mode is carried out in accordance with an instruction from a user, storing, in the storage section, the initial state data in which the detection states of the non-monitored person detecting sensors at the time of the switching to the alert mode or after a predetermined period has elapsed from the switching to the alert mode are associated with the accumulative frequencies of the detection states, and the initial state detection means compares a pattern of the detection states of the non-monitored person detecting sensors with highest accumulative frequency patterns, the number of which is predetermined, in the initial state data stored in the storage section, so as to detect a matching therebetween.

12. A security system comprising:

a control device for performing a predetermined coping action when an abnormality is detected in a monitored area;

an outing motion detection sensor for detecting actions of a non-monitored person when leaving the monitored area; and a non-monitored person detecting sensor for detecting the non-monitored person in the monitored area, the control device including:

mode switching means for switching between an alert mode with which the coping action is performed if the abnormality is detected in the monitored area and a non-alert mode with which the coping action is not performed, the mode switching means automatically switching to the alert mode when the outing motion detection sensor detects that the non-monitored person has left the monitored area, the non-monitored person detecting sensor does not detect any other non-monitored person, and the non-alert mode has been set.

13. A security system comprising:

a control device for performing a predetermined coping action when an abnormality is detected in a monitored area; and a plurality of non-monitored person detecting sensors for detecting the non-monitored person in the monitored area, the control device including:

mode switching means for switching between an alert mode with which the coping action is performed if the abnormality is detected in the monitored area and a non-alert mode with which the coping action is not performed;

a storage section for storing initial state data that indicates initial states of the non-monitored person detecting sensors in the alert mode; and initial state detection means for detecting a matching between detection states of the non-monitored person detecting sensors and the initial state data, the mode switching means automatically switching to the alert mode, when the detection states of the non-monitored person detecting sensors are matched with the initial state data, and the non-alert mode has been set.

14. The security system according to claim 13, further comprising:

mode switching report means for causing a remote alarm device located at a remote place to present mode change report information, when the mode switching means automatically switches to the alert mode.

15. A control method for a security system which can switch between an alert mode with which a predetermined coping action is performed if the abnormality is detected in a monitored area and a non-alert mode with which the coping action is not performed, the method comprising:

an initial state detecting step of detecting a matching between detection states of a plurality of non-monitored person detecting sensors and initial states of the non-monitored person detecting sensors in the alert mode, the non-monitored person detecting sensors each detecting a non-monitored person in the monitored area; and a mode switching reminder step of causing a remote alarm device located at a remote place to present mode change reminder information, when the detection states of the non-monitored person detecting sensors are matched with the initial states, and the non-alert mode has been set.

16. A control method for a security system which can switch between an alert mode with which a predetermined coping action is performed if the abnormality is detected in a monitored area and a non-alert mode with which the coping action is not performed, the method comprising:

an initial state detecting step of detecting a matching between detection states of a plurality of non-monitored person detecting sensors and initial states of the non-monitored person detecting sensors in the alert mode, the non-monitored person detecting sensors each detecting a non-monitored person in the monitored area; and an automatic switching step of automatically switching to the alert mode, when the detection states of the non-monitored person detecting sensors are matched with the initial states, and the non-alert mode has been set.

17. A computer-readable storage medium storing therein a control program according to claim 16 when execute it for causing a computer to function as each of the foregoing means.

* * * * *